US007434903B2

(12) United States Patent
Okuda

(10) Patent No.: US 7,434,903 B2
(45) Date of Patent: Oct. 14, 2008

(54) DROPLET EJECTION HEAD DRIVING METHOD, DROPLET EJECTION HEAD AND DROPLET EJECTION DEVICE

(75) Inventor: Masakazu Okuda, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 419 days.

(21) Appl. No.: 11/351,852

(22) Filed: Feb. 10, 2006

(65) Prior Publication Data

US 2007/0052756 A1 Mar. 8, 2007

(30) Foreign Application Priority Data

Sep. 5, 2005 (JP) ..... 2005-256311

(51) Int. Cl.
*B41J 29/38* (2006.01)

(52) U.S. Cl. ..... 347/10; 347/68

(58) Field of Classification Search ..... 347/5, 347/9–11, 54, 68, 70–72
See application file for complete search history.

(56) References Cited

U.S. PATENT DOCUMENTS 6,962,398 B2 * 11/2005 Okuda et al. ..... 347/10

* cited by examiner

*Primary Examiner*—Juanita D Stephens
(74) *Attorney, Agent, or Firm*—Fildes & Outland, P.C.

(57) ABSTRACT

A droplet ejection head driving method applies a driving voltage waveform to pressure-generating means, thus pressurizing a liquid in a pressure chamber and causing a droplet to be ejected. The driving voltage waveform includes a first voltage change process, which expands the pressure chamber, and a second voltage change process, after the first voltage change process, which shrinks the pressure chamber. A time interval between the first voltage change process and the second voltage change process is not more than ⅛ of a resonance period Tm of a meniscus oscillation (a refill oscillation), which is governed by surface tension of the liquid at a nozzle portion.

14 Claims, 28 Drawing Sheets

FIG.4A
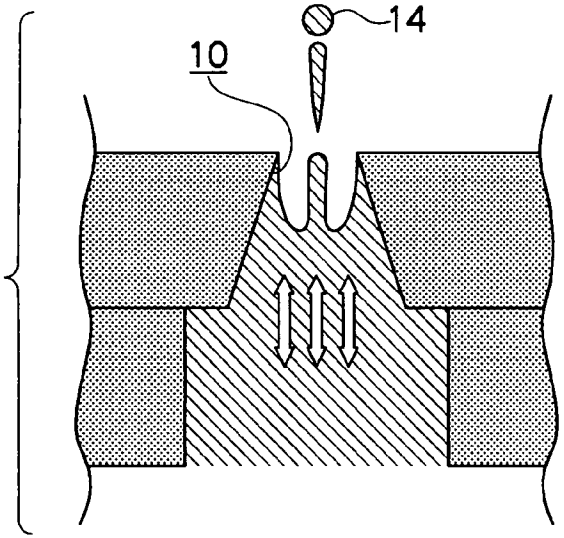
FIG.4B
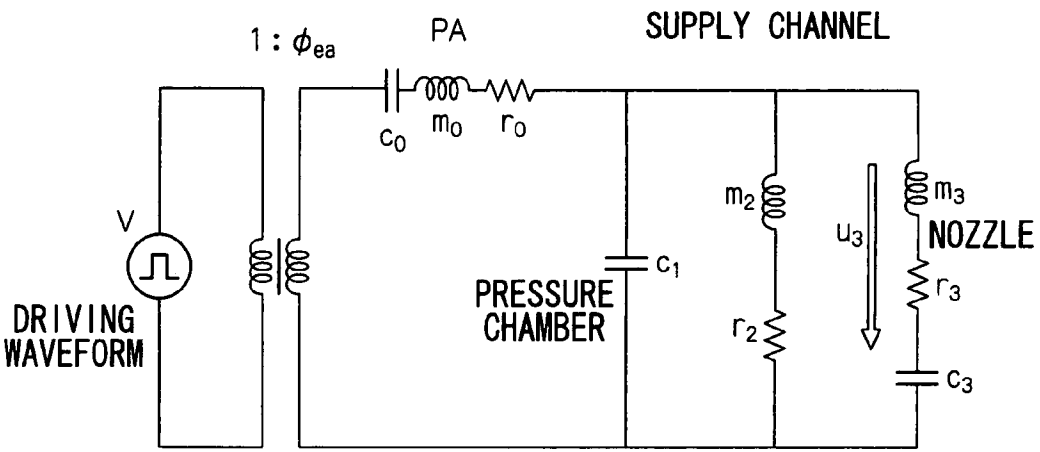
FIG.4C
$$u_3(t) = \frac{c_0\phi}{cm_3E_c}\exp(-D_c \cdot t)\sin(E_c \cdot t)$$
$$T_c = 2\pi\sqrt{\frac{m_2m_3}{m_2+m_3}\cdot(c_0+c_1)}$$
FIG.4D
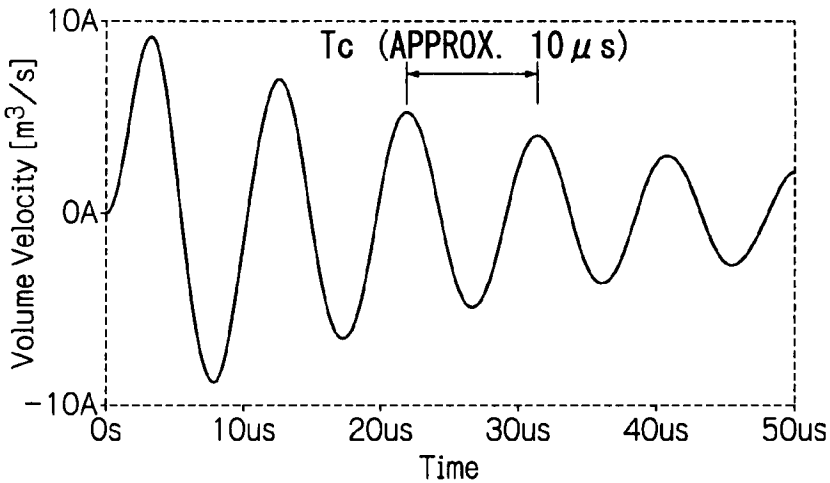

FIG.5A
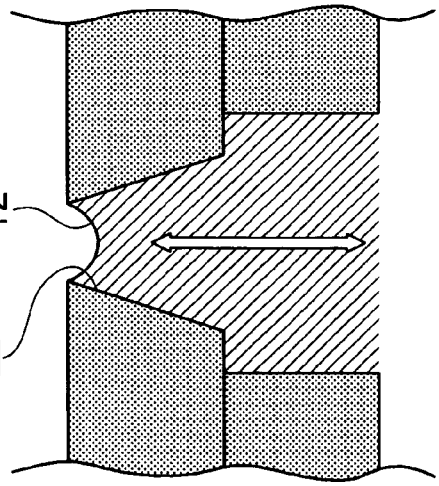
FIG.5B
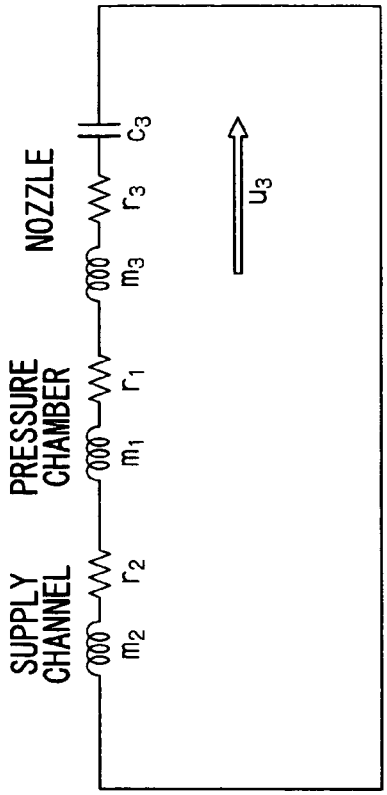
FIG.5C
$$(m_1+m_2+m_3)\frac{d^2y}{dt}+(r_1+r_2+r_3)\frac{dy}{dt}+\frac{1}{c_3}y=0$$
$$c_3=\frac{\pi d_3^4}{64\sigma}\sqrt{1+\frac{16x^2}{d_3^2}}$$
$$T_m=2\pi\sqrt{(m_1+m_2+m_3)c_3}$$
FIG.5D
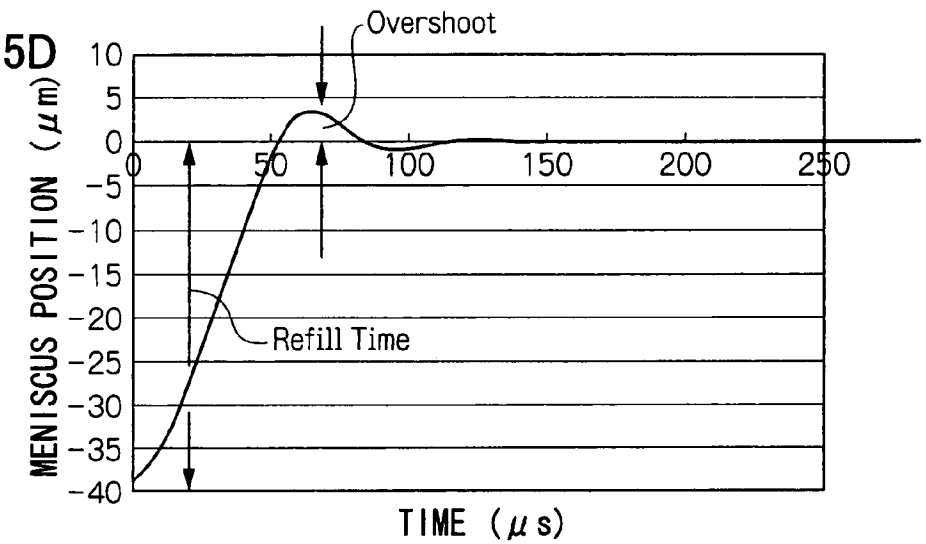

MENISCUS SPEED (m/s)
TIME (μs)
Tc (APPROX. 10μs)

MENISCUS SPEED (m/s)
TIME (μs)
Tm (APPROX. 40 μs)

MENISCUS SPEED (m/s)
TIME (μs)
ACOUSTIC OSCILLATION SYSTEM
REFILL OSCILLATION SYSTEM
TOTAL
SOURCE OF OCCURRENCE OF MENISCUS PROTRUSION
A
IN AN ACTUAL MENISCUS OSCILLATION, TWO OSCILLATIONS, DUE TO THE ACOUSTIC OSCILLATION SYSTEM AND THE REFILL OSCILLATION SYSTEM, ARE SUPERIMPOSED.

DROPLET EJECTION HEAD DRIVING METHOD, DROPLET EJECTION HEAD AND DROPLET EJECTION DEVICE

CROSS-REFERENCE TO RELATED APPLICATION

This application claims priority under 35 USC 119 from Japanese Patent Application No. 2005-256311, the disclosure of which is incorporated by reference herein.

BACKGROUND OF THE INVENTION

1. Field of the Invention

The present invention relates to a droplet ejection head driving method, a droplet ejection head and a droplet ejection device, and more particularly relates to an inkjet recording head and driving method for ejecting microscopic ink droplets with piezoelectric elements, and an inkjet recording device.

2. Description of the Related Art

A droplet ejection head which employs electromechanical conversion elements, such as piezoactuators (piezoelectric elements) or the like, can accurately control meniscus operations at a nozzle portion by applying a driving waveform to an electromechanical conversion element, and consequently has an advantage in being able to realize microdroplet ejections, control of satelliting/misting and the like.

In particular, a "pull-push" system, which draws a meniscus back into a nozzle immediately prior to droplet ejection and then performs ejection of the droplet, is extremely effective as a system for discharging microdroplets with very small droplet volumes (see, for example, the publications of Japanese Patent Nos. 3,275,965 and 3,159,188).

However, when a droplet ejection is performed by the above-described "pull-push" system, a phenomenon in which the meniscus greatly protrudes from a nozzle aperture just after the drop is ejected (a meniscus protrusion effect) occurs. This adversely affects frequency characteristics of droplet ejection, and there are problems in that ejections cannot be performed if a driving frequency is raised, and ejection stability characteristics, such as ejection direction, droplet size and the like, deteriorate.

Specifically, when the meniscus protrusion effect occurs just after droplet ejection, as shown in FIG. 3A, liquid protruding from an aperture portion of a nozzle 10 flows out onto a nozzle face, and enters a state in which the liquid wets surroundings of the nozzle 10 (a face flood state). When this face flooding occurs, there are problems in that it is not possible to perform ejections of droplets properly (and in worst cases there are ejection failures), and quality of a recorded image is greatly degraded.

Further, even if the face flood state shown in FIG. 3A is not reached, outflow of the liquid (wetting) may occur at a portion of the nozzle surroundings. In such a case, ejection of a droplet is possible but, as shown in FIG. 3B, a tail of a droplet 14 is drawn to one side, as a result of which a deterioration in an ejection direction characteristic occurs, which causes a reduction in quality of an output image.

In particular, if liquid-repellence of the surface around the nozzle 10 is low, that is, if a wetting characteristic is high, the problems described above are more likely to occur. Therefore, a liquid-repellent film with high quality and uniformity is required at the nozzle surface, and there is a resultant problem in that this leads to an increase in costs of the droplet ejection head.

Further, if a high liquid-repellence characteristic is maintained around the nozzle and overflowing of the liquid to the surroundings of the nozzle can be suppressed, a subsequent ejection still cannot be performed until a protruding meniscus 12, as shown in FIG. 3C, is returned to the nozzle aperture portion by the action of surface tension. Therefore, it is difficult to perform ejections of liquid droplets at high driving frequencies. As a result, a driving frequency of the head must be kept low, and processing capabilities of an overall device are reduced.

As described above, a conventional pull-push system has problems in being susceptible to the occurrence of the meniscus protrusion phenomenon just after droplet ejection, and consequently having difficulty with performing high-quality recording at high speeds.

A goal of the present invention is to solve the problems described above. Accordingly, for a droplet ejection head which performs droplet ejections by a pull-push system, a droplet ejection head driving method which suppresses meniscus protrusion just after droplet ejection and enables droplet ejection at high frequencies with excellent ejection stability characteristics is provided. An additional object of the present invention is to provide a droplet ejection device which can stably eject droplets with small droplet volumes at high frequency and can perform high-quality recording at high speed.

Conventionally, timings of voltage changes in a driving waveform have been implemented on the basis of an acoustic oscillation system, that is, of a resonance period (a Helmholtz oscillation period) Tc of a pressure wave which occurs in a pressure chamber. However, it has been established that there are two oscillation systems in an ejection head: the above-mentioned acoustic oscillation system and a refill oscillation system, which is oscillation of a meniscus due to surface tension at a nozzle.

The acoustic oscillations and the refill oscillations are both energized at the same time by application of a driving waveform. It has been learned that the problematic meniscus protrusion is caused by the latter, the refill oscillations, and a low-frequency meniscus oscillation caused by the refill oscillation system causes the meniscus to protrude just after droplet ejection.

Accordingly, the present invention will implement design of a driving waveform based on the refill oscillation system, that is, on a period Tm of meniscus oscillations that are caused by surface tension at a nozzle, and will effectively suppress meniscus protrusion.

SUMMARY OF THE INVENTION

In consideration of the circumstances described above, objects of the present invention are to provide a droplet ejection head driving method which, at a droplet ejection head which performs droplet ejection by a pull-push system, suppresses meniscus protrusion just after droplet ejection and enables droplet ejection with excellent frequency characteristics and ejection stability characteristics, and to provide a droplet ejection device which can stably eject droplets with small droplet volumes at high frequency and can perform high-quality recording at high speed.

In a first aspect of the present invention, a droplet ejection head driving method applies a driving voltage waveform to pressure-generating means for pressurizing fluid in a pressure chamber and ejecting a droplet, wherein the driving voltage waveform includes a first voltage change process, which expands the pressure chamber, and a second voltage change process, which shrinks the pressure chamber, after the first voltage change process, and wherein a time interval between the first voltage change process and the second voltage change process is not more than ⅛ of a resonance period Tm of a meniscus oscillation, which is a refill oscillation which is governed by surface tension of the fluid at a nozzle portion.

According to the present aspect, it is possible to make meniscus protrusion amounts just after droplet ejections smaller, and it is consequently possible to improve frequency characteristics and stability characteristics of droplet ejection.

In a second aspect of the present invention, a ratio (V2/V1) of a voltage change amount V1 of the first voltage change process and a voltage change amount V2 of the second voltage change is set in a range from 0.8 to 1.2.

According to the present aspect, it is possible to make meniscus protrusion amounts just after droplet ejections smaller, and it is consequently possible to improve frequency characteristics and stability characteristics of droplet ejection.

A third aspect of the present invention further includes a third voltage change process, which expands the pressure chamber, just after the second voltage change process.

According to the present aspect, it is possible to eject a small droplet by applying to the meniscus an action which pinches off the droplet at a time of completion of ejection.

In a fourth aspect of the present invention, a time interval between the second voltage change process and the third voltage change process is set to be not more than ¼ of a resonance period Tc, which is a Helmholtz resonance period, of a pressure wave which is caused by the pressure-generating means.

According to the present aspect, it is possible to assure a satisfactory droplet miniaturization effect while suppressing an increase in meniscus protrusion amounts.

In a fifth aspect of the present invention, a ratio (V3/V2) of a voltage change amount V3 of the third voltage change process and a voltage change amount V2 of the second voltage change process is set in a range from 0.5 to 0.8.

With the invention of the structure described above, it is possible to assure a satisfactory droplet miniaturization effect while suppressing an increase in meniscus protrusion amounts.

A sixth aspect of the present invention further includes a fourth voltage change process, which shrinks the pressure chamber, after the third voltage change process, wherein a time interval between the third voltage change process and the fourth voltage change process is set to be not more than 1/10 of the resonance period Tm of the meniscus oscillation.

According to the present aspect, meniscus oscillations that are energized by the third voltage change and fourth voltage change processes counteract, and it is possible to reduce a meniscus protrusion amount just after droplet ejection.

In a seventh aspect of the present invention, a ratio (V4/V3) of a voltage change amount V3 of the third voltage change process and a voltage change amount V4 of the fourth voltage change process is set in a range from 0.5 to 0.8.

According to the present aspect, it is possible to assure a satisfactory reverberation suppression effect while suppressing an increase in meniscus protrusion amounts.

In an eighth aspect of the present invention, driving is performed by the driving method of any of the first to seventh aspects, with the resonance period Tc of the pressure wave which occurs in the pressure chamber being set at not more than ¼ of the resonance period Tm of the meniscus oscillations.

According to the present aspect, it is possible to reduce meniscus protrusion amounts just after droplet ejections while ejecting droplets efficiently, and it is consequently possible to improve frequency characteristics and stability characteristics of droplet ejection.

In a ninth aspect of the present invention, the pressure-generating means includes a piezoelectric element, which is driven by the driving method of any of the above-described first to eighth aspects.

With the invention of the structure described above, it is possible to make meniscus protrusion amounts just after droplet ejections smaller, and it is consequently possible to improve frequency characteristics and stability characteristics of droplet ejection.

In a tenth aspect of the present invention, a droplet ejection head is driven by the driving method of any of the above-described first to ninth aspects.

According to the present aspect, it is possible to make meniscus protrusion amounts just after droplet ejections smaller, and it is consequently possible to improve frequency characteristics and stability characteristics of droplet ejection.

In an eleventh aspect of the present invention, ejection of droplets is performed using a droplet ejection head based on the above-described tenth aspect.

According to the present aspect, it is possible to make meniscus protrusion amounts just after droplet ejections smaller, and it is consequently possible to form a droplet ejection device with improved frequency characteristics and stability characteristics of droplet ejection.

In conclusion, according to the present invention, for a droplet ejection head which performs droplet ejection by a pull-push system, a droplet ejection head driving method is provided which suppresses a meniscus protrusion immediately after droplet ejection, and which enables droplet ejection with excellent frequency characteristics and ejection stability characteristics. Furthermore, it is possible to stably eject droplets with small droplet volumes at high frequencies, and it is possible to form a droplet ejection device which can perform recording with high image quality at high speed.

BRIEF DESCRIPTION OF THE DRAWINGS

FIGS. 4A to 4D are illustrations showing an acoustic oscillation system of a droplet ejection head relating to the present invention.

FIGS. 5A to 5D are illustrations showing a refill oscillation system of the droplet ejection head relating to the present invention.

DETAILED DESCRIPTION OF THE INVENTION

—Driving Waveforms and Frequency Characteristics—

Figure 1A:
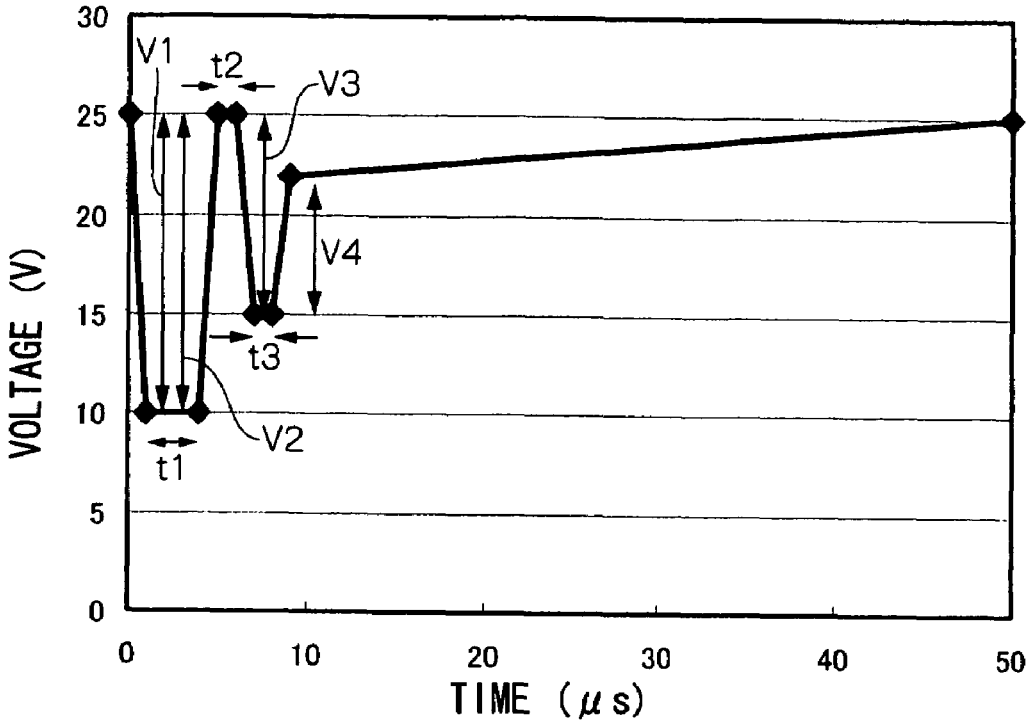
FIGS. 1A and 1B are graphs showing driving waveforms of droplet ejection heads in relation to the present invention.

FIGS. 1A, 1B, 2A and 2B show driving waveforms and frequency characteristics of droplet ejection heads in relation to a first embodiment of the present invention. As shown in FIG. 1A, a droplet ejection head driving voltage waveform relating to the present embodiment is constituted with a first voltage change D1, which enlarges a pressure generation chamber, and then a second voltage change D2, which shrinks the pressure generation chamber. Here, a resonance period (Tm) of a refill oscillation system of a droplet ejection head which is utilized for the present embodiment is 40 μs, and a resonance period of pressure waves (a Helmholtz resonance period) Tc is 8 μs. Further, the pressure generation chamber expands when voltage of the driving waveform is reduced, and the pressure generation chamber contracts when the voltage is increased.

A time interval t1 between the first voltage change D1 and the second voltage change D2 is 5 μs, and is set to be not more than ⅛ of the resonance period Tm (40 μs) of the refill oscillations of the droplet ejection head. Further, a ratio (V2/V1) between a voltage change amount V1 of the first voltage change D1 (15 volts) and a voltage change amount V2 of the second voltage change D2 (15 volts) is set in a range from 0.8 to 1.2 (here, 1.0).

Additionally, a third voltage change D3, for expanding the pressure generation chamber, is included just after the second voltage change D2. A ratio (V3/V2) between a voltage change amount V3 of the third voltage change D3 (10 volts) and the voltage change amount V2 of the second voltage change D2 (15 volts) is set in a range from 0.5 to 0.8 (here, 0.67). Further, a time interval t2 (2 μs) between the second voltage change D2 and the third voltage change D3 is set to be not more than ¼ of the resonance period Tc of pressure waves (the Helmholtz resonance period).

Further, a time interval t3 (2 μs) between a fourth voltage change D4, which shrinks the pressure generation chamber just after the third voltage change D3, and the third voltage change D3 is set to be not more than ⅒ of Tm (40 μs). A ratio (V4/V3) between the voltage change amount V3 of the third voltage change D3 (10 volts) and the voltage change amount V4 of the fourth voltage change D4 (7 volts) is set in a range from 0.5 to 0.8 (here, 0.7).

Figure 1B:
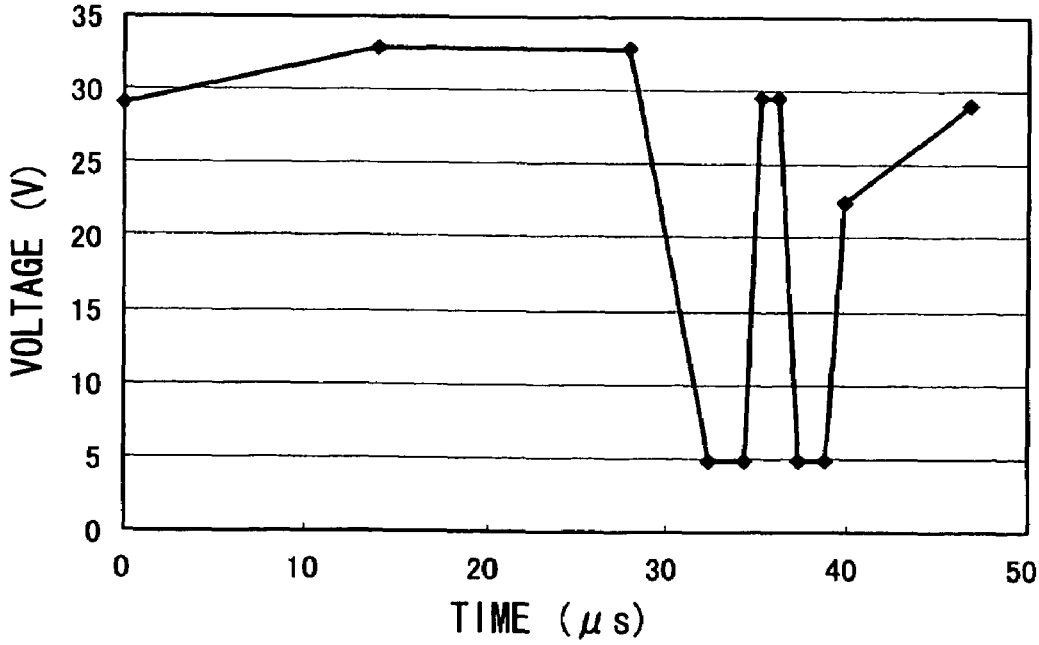
Figure 2A:
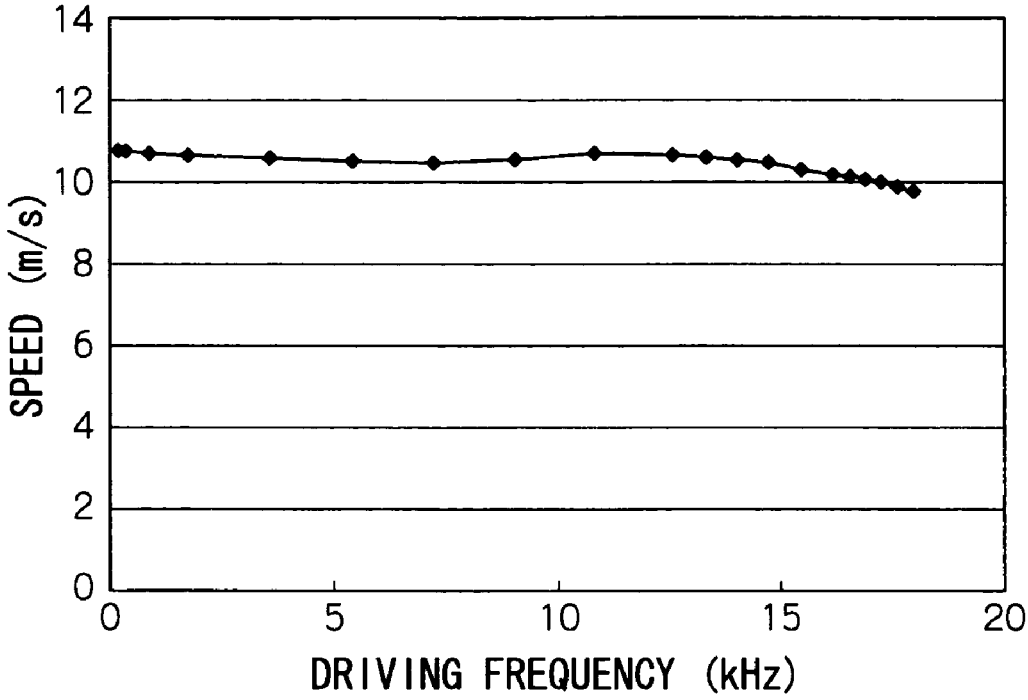
FIGS. 2A and 2B are graphs showing frequency characteristics of the droplet ejection heads in relation to the present invention.
Figure 2B:
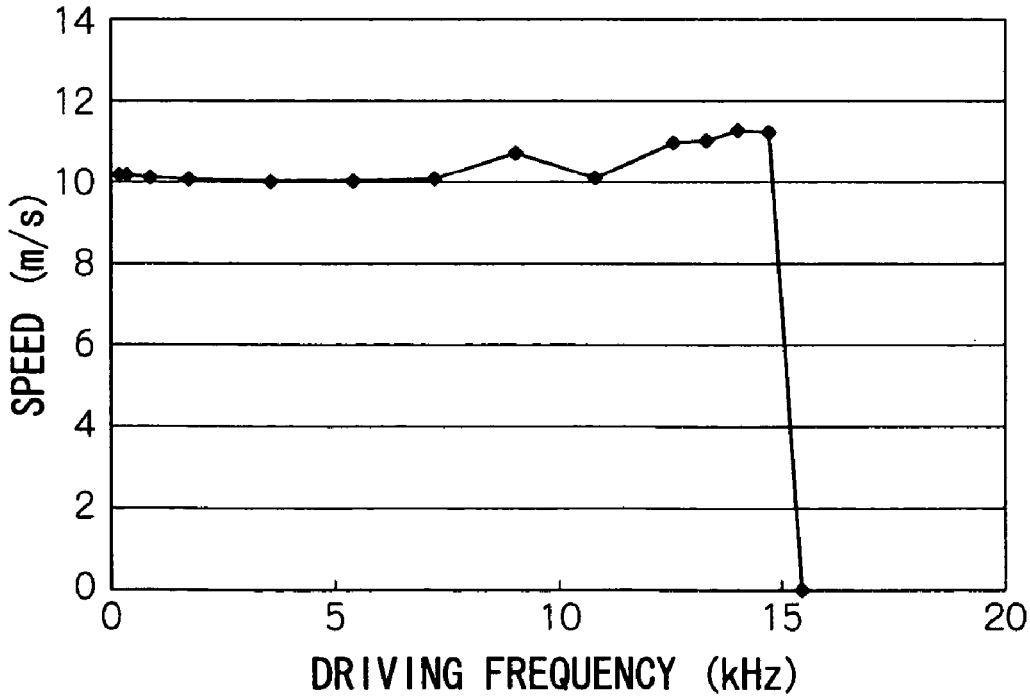
Figure 3C:
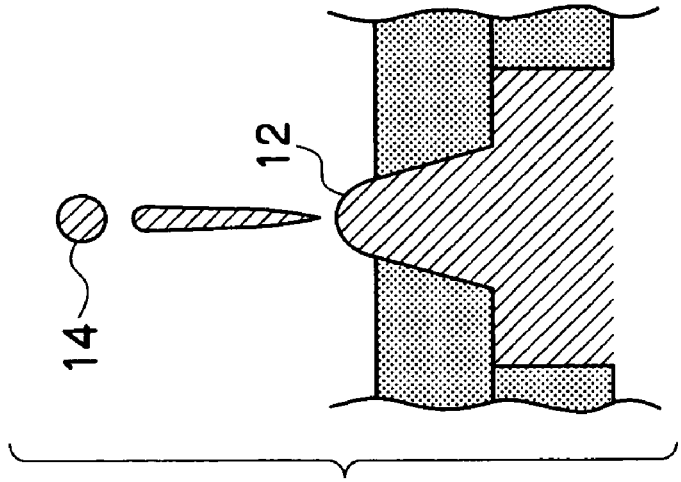
FIGS. 3A to 3C are views showing meniscus protrusions of a conventional droplet ejection head.
Figure 3B:
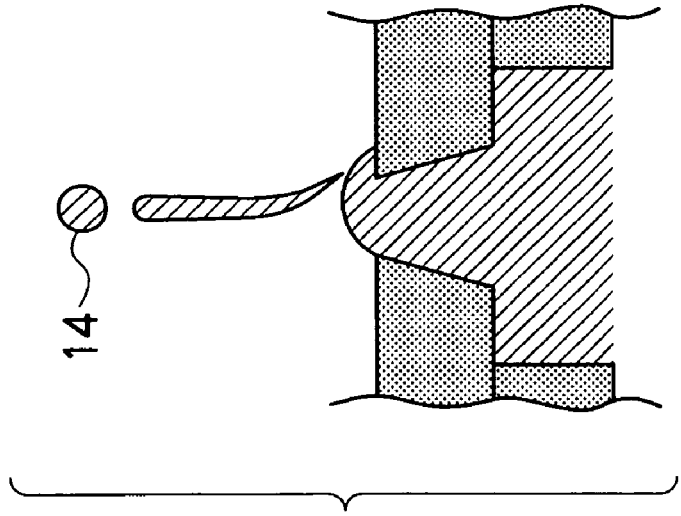
Figure 3A:
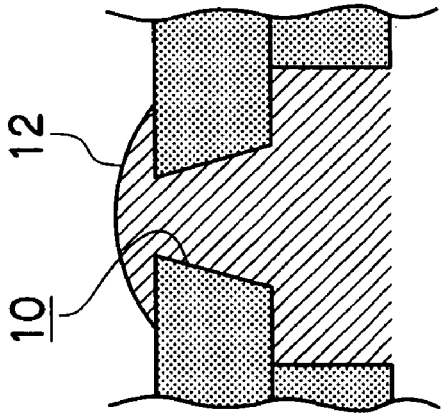

With a droplet ejection head which is driven by a conventional driving waveform, for example, as shown in FIG. 1B, ejections are unstable at driving frequencies of 7 kHz or more, as shown in FIG. 2B, and ejection is made impossible by the effects of meniscus oscillations at 16 kHz.

However, with driving of a droplet ejection head by the above-described driving waveform of FIG. 1A, meniscus oscillations are suppressed and, as shown in FIG. 2A, stable ejections can be performed up to a driving frequency of 18 kHz.

That is, although the driving waveform of FIG. 1A, which is an embodiment of the present invention, is the same as the conventional driving waveform shown in FIG. 1B in basic structure, featuring the first to fourth voltage changes, the design concept of the driving waveform is greatly different, in that the time intervals between the voltage changes and the voltage change amounts of the voltage changes are set so as to make meniscus protrusion amounts smaller. Thus, a remarkable effect can be obtained in that frequency characteristics of droplet ejection are improved, as shown in FIGS. 2A and 2B.

Meniscus protrusion amounts consequent to movements of principal components will be described below.

—Acoustic Oscillation System and Refill Oscillation System—

FIGS. 4A to 4D, 5A to SD, and 6A to 6C show meniscus oscillations caused by acoustic oscillations and refill oscillations of a droplet ejection head relating to the present invention.

The resonance period (Helmholtz resonance period) Tc of pressure waves which occur in the pressure chamber of the droplet ejection head, as shown in FIG. 4A, is described by the equations of FIG. 4C if the droplet ejection head acts overall as the circuit shown in FIG. 4B. Here, 'm' indicates an inertance, 'r' indicates an acoustic resistance and 'c' indicates an acoustic capacitance. The suffix '0' refers to a piezoelectric actuator (PA), the suffix '1' refers to the pressure chamber, the suffix '2' refers to a supply channel, and the suffix '3' refers to a nozzle. Further, ϕea represents an electromechanical conversion coefficient.

Thus, a change in volume velocity which is caused in the nozzle 10 by a pressure wave (the black arrows in FIG. 4A) is shown by u3 (the black arrow) in FIG. 4B, and is described as a function of time t by an equation shown in FIG. 4C.

The period Tc of the volume velocity u3 is comparatively short at around 10 μs, as shown in FIG. 4D, and a continuous, attenuating sine wave form with period Tc is assumed. This oscillation (the acoustic oscillation system) features the governing forces that affect volume, speed and the like of a droplet that is ejected.

Heretofore, it has not been possible to implement designs of driving waveforms which include countermeasures against meniscus oscillations on the basis of a resonance period Tc of pressure waves of acoustic oscillations and thus to suitably prevent meniscus protrusion as described above, and there have been effects such as degradation of ejection direction characteristics of droplets, limitations on driving frequencies and the like.

In contrast, a resonance period Tm of meniscus oscillations, which are governed by surface tension forces at the nozzle 10 of the droplet ejection head, as shown in FIG. 5A, is described by the equations of FIG. 5C if the droplet ejection head acts overall as the circuit shown in FIG. 5B.

Thus, a meniscus oscillation of the nozzle 10 of FIG. 5A (the black arrow in the drawing) is shown by u3 in FIG. 5B (the black arrow in the drawing), and is described by the equations shown in FIG. 5C.

The resonance period Tm of the refill oscillation system is a period which is comparatively long, for example, as shown in FIG. 5D. After a meniscus position subsequent to droplet ejection returns to zero (a refill duration), the meniscus position protrudes from the nozzle 10 (overshoots), and converges only slowly, for example, over a period of around 150 μs as shown in FIG. 5D. This oscillation (the refill oscillation system) features the governing forces that affect a refill (recharging) time of droplets that are ejected, driving frequency and the like.

With the present invention, design of a driving waveform which includes countermeasures against meniscus oscillations on the basis of the resonance period Tm of the refill oscillations is implemented. Thus, meniscus protrusion is suitably prevented, and effects such as degradation of ejection direction characteristics of droplets, limitation of driving frequencies and the like are eliminated, which was difficult with conventional driving waveforms.

Figures 6A, 6B, 6C:
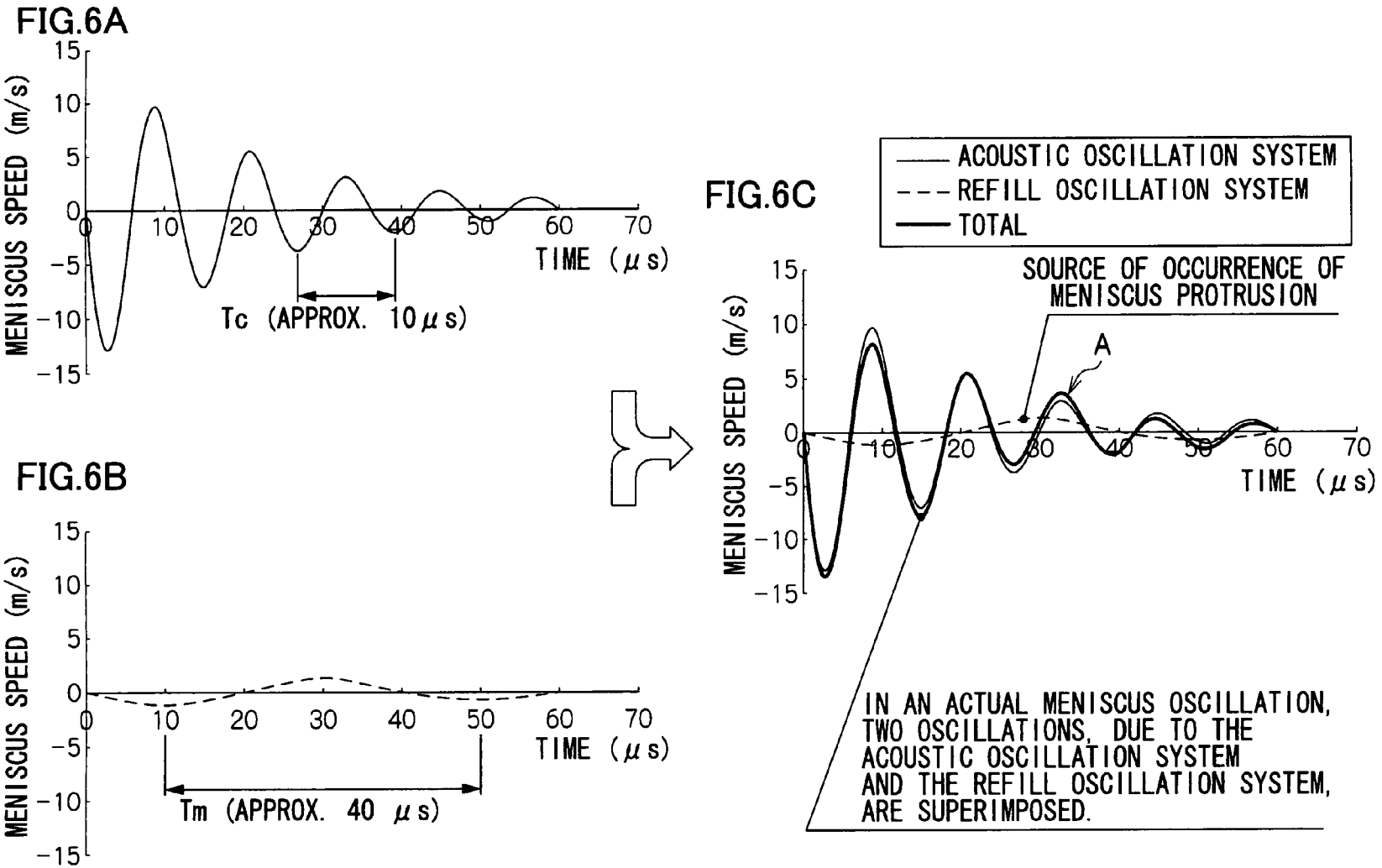
FIGS. 6A to 6C are graphs showing meniscus protrusion of the droplet ejection head relating to the present invention.

That is, meniscus oscillations in practice are affected by both the effect of acoustic oscillations, for example, as shown in FIG. 6A (Tc=approx. 10 μs) and the effect of refill oscillations as shown in FIG. 6B (Tm=approx. 40 μs). In this manner, as shown in FIG. 6C, the two oscillations are superimposed to form a composite wave. Accordingly, when an amplitude of meniscus oscillations is larger because of the refill oscillations, a large meniscus protrusion occurs at a region A shown in FIG. 6C, ejection failures occur as described earlier, and problems arise in that ejection stability characteristics such as ejection direction, droplet size and the like are adversely affected.

Next, the effects of various parameters will be separately described.

—Pulse Width t1 and Tm—

FIGS. 7A to 9B show relationships between pulse widths and meniscus protrusion amounts in relation to the present invention.

FIGS. 7A and 7B, 8A and 8B, and 9A and 9B are graphs showing how a meniscus protrusion amount varies with settings of a pulse width, that is, a time interval t1 between the first voltage change D1 and the second voltage change D2 in a simple "pull-push" driving system with a single pulse.

Figure 7A:
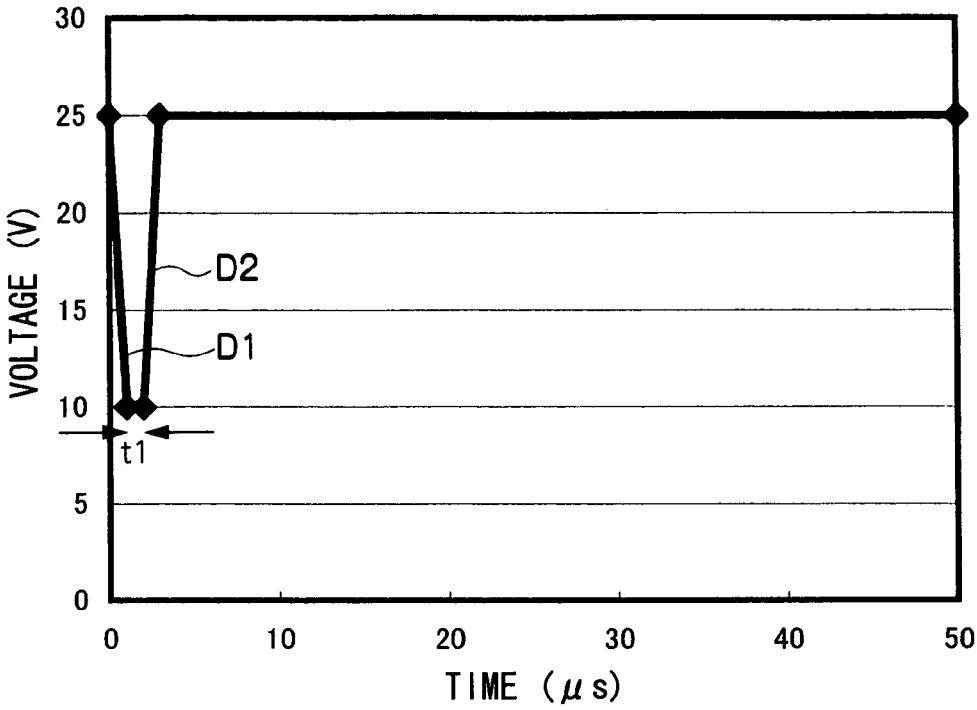
FIGS. 7A and 7B are graphs showing a relationship between a pulse width of a driving waveform and a meniscus protrusion amount in relation to the present invention.
Figure 7B:
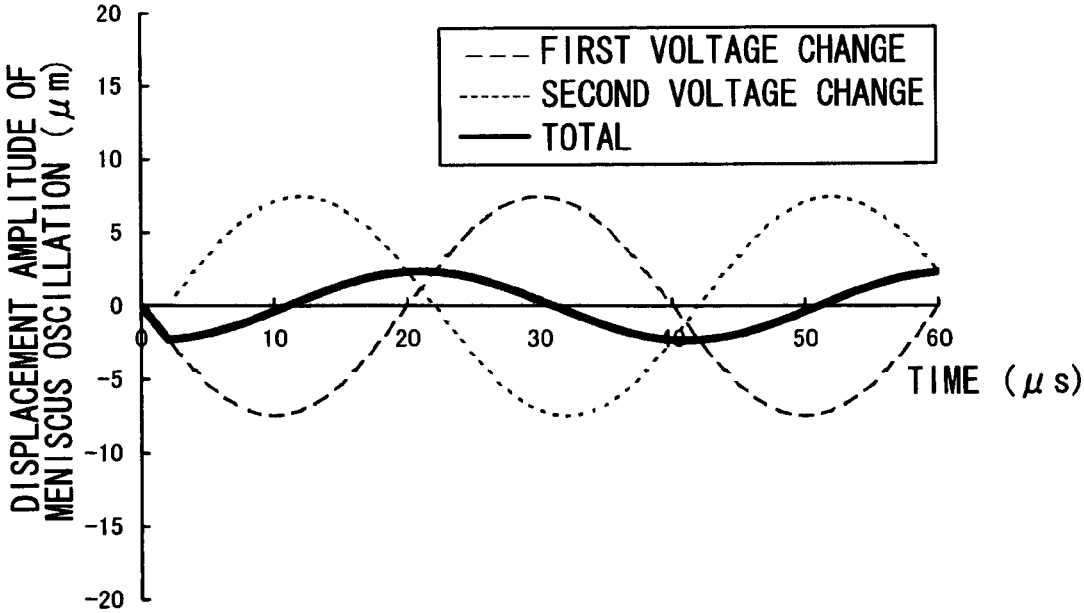
Figure 8A:
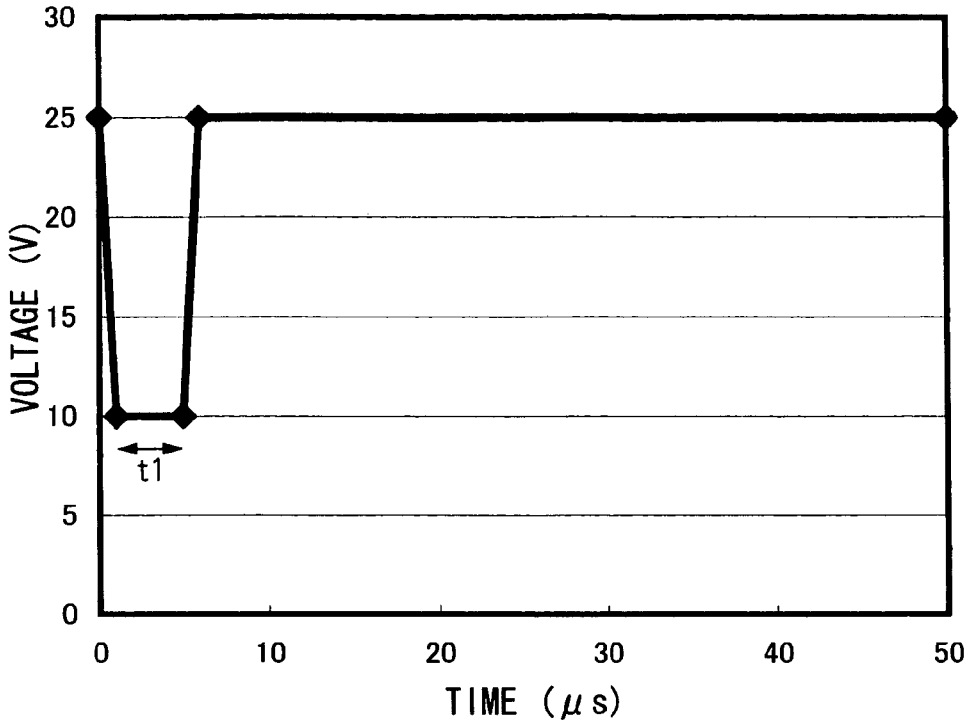
FIGS. 8A and 8B are graphs showing a relationship between a pulse width of a driving waveform and a meniscus protrusion amount in relation to the present invention.
Figure 8B:
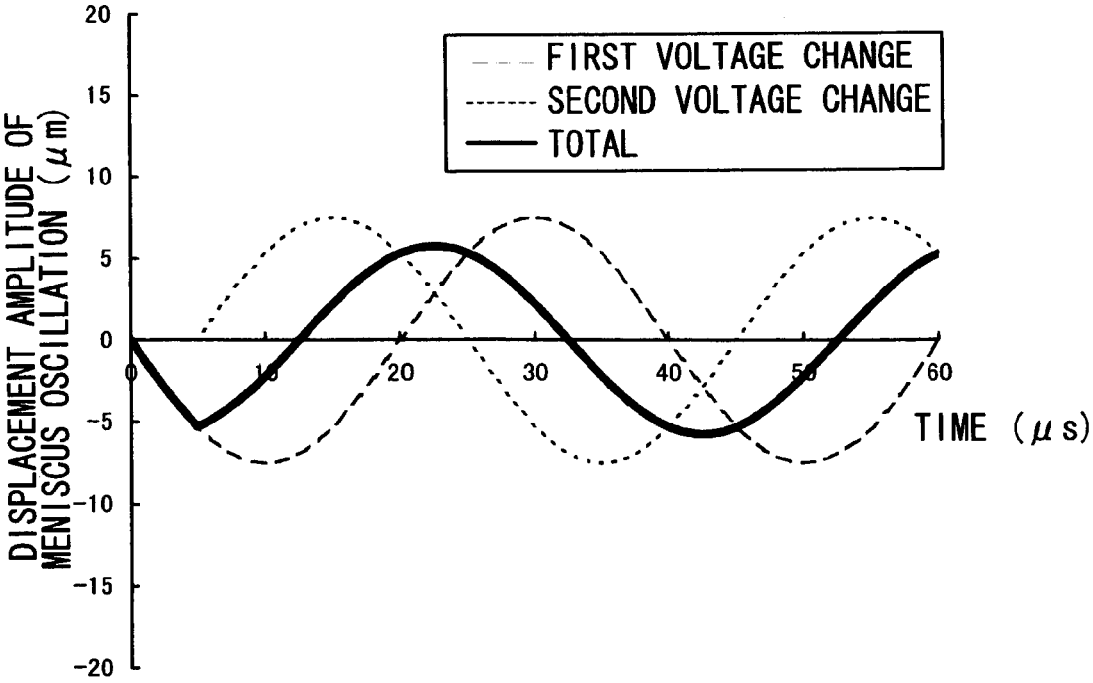
Figure 9A:
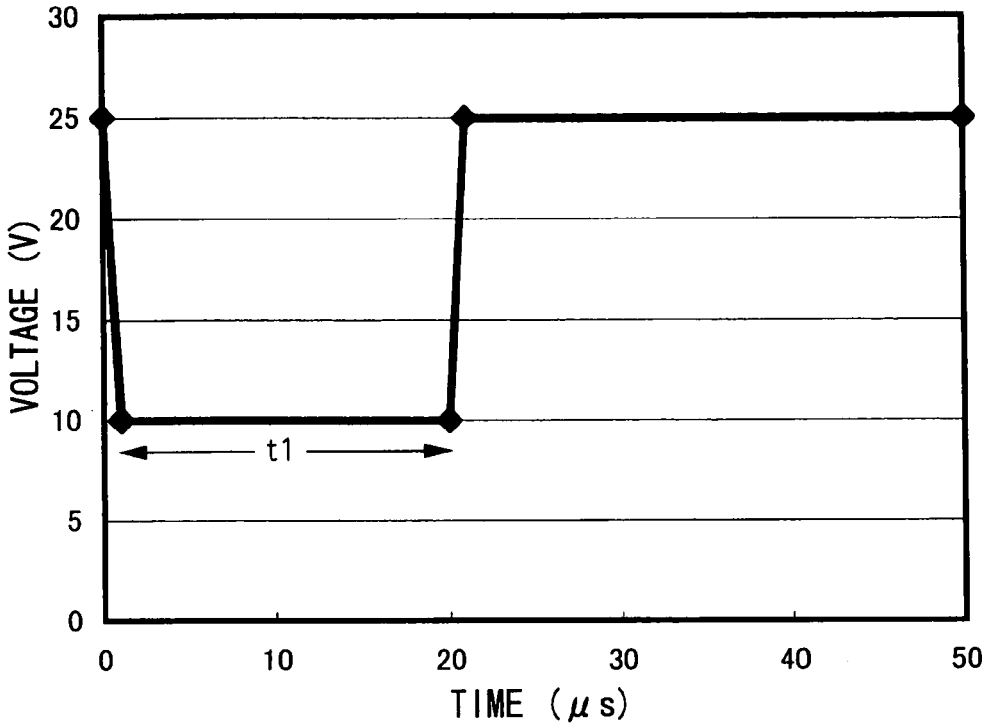
FIGS. 9A and 9B are graphs showing a relationship between a pulse width of a driving waveform and a meniscus protrusion amount in relation to the present invention.
Figure 9B:
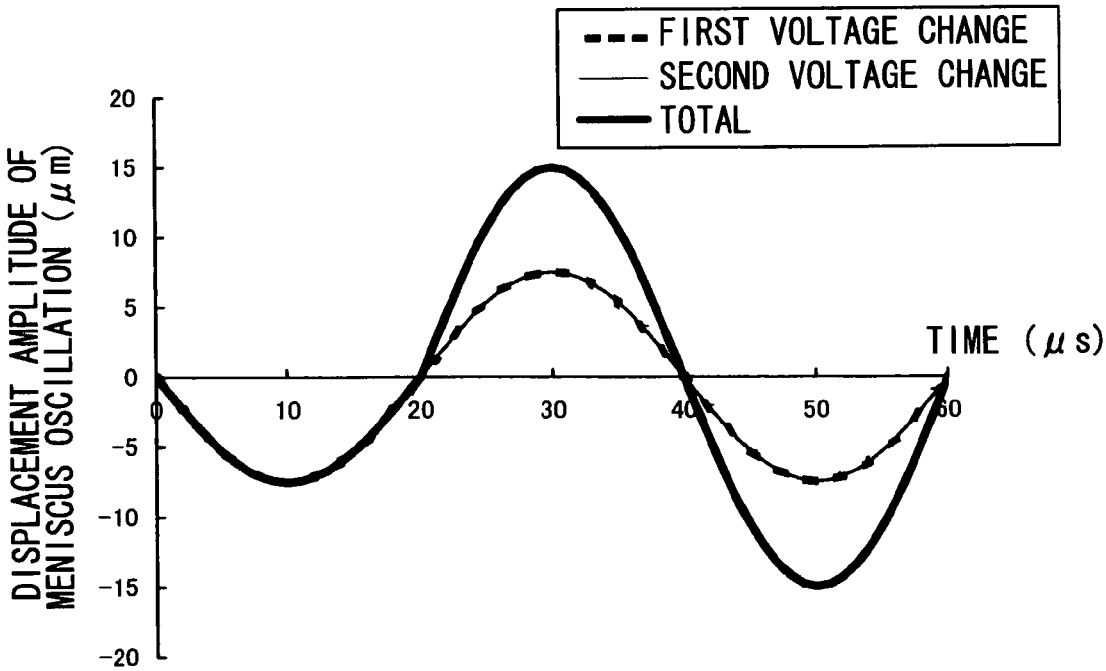

FIGS. 7B, 8B and 9B show displacement amplitudes of meniscus oscillations which are caused by the voltage change portions D1 and D2 of the driving waveforms. The thick black lines represent displacement amplitudes of practical meniscus oscillations when the voltage changes D1 and D2 are added together. Further, pressure waves when a droplet is ejected as described above, that is, meniscus oscillations due to acoustic oscillations, are also superimposed.

That is, the smaller the amplitude of the thick black line (in the vertical direction of the drawings), the smaller the meniscus protrusions just after droplet ejection are suppressed.

FIGS. 7A and 7B are a case in which the pulse width t1 is 2 μs and the ratio t1/Tm relative to the resonance period Tm of the refill oscillation system is 1/20. The result is that amplitude displacements caused by the original voltage changes D1 and D2 cancel one another out for the thick black line representing the displacement amplitude of the meniscus oscillations, and this amplitude is suppressed to no more than half relative to the respective displacements.

In contrast, in FIGS. 8A and 8B, t1 is 5 μs and t1/Tm is 1/8. Because a difference in phases between the two amplitude displacements is reduced, the amplitude of the composite wave is larger than in FIGS. 7A and 7B. Further, in FIGS. 9A and 9B, t1 is 20 μs and t1/Tm is 1/2. Consequently, the difference between phases is eliminated, and the amplitude of the composite wave is as large as the amplitudes of the two amplitude displacements being added.

As is seen from FIGS. 7A to 9B hereabove, the smaller the pulse width (t1), the smaller the meniscus protrusion amount. This is because, when t1 is small, a meniscus oscillation which is excited by a "pull" (i.e., the first voltage change D1) is effectively counteracted by a meniscus oscillation which is excited by a "push" (i.e., the second voltage change D2). In contrast, if t1 is set to 1/2 of Tm and the phases of the meniscus oscillations of the push and the pull are aligned, as shown in FIGS. 9A and 9B, the oscillation is amplified and consequently meniscus protrusion amounts are increased.

There are also timings with which the two phases are opposite beyond these values of t1. However, if t1 is increased thereto, naturally, the frequency of ejections cannot be raised (because more time is taken for a single ejection). Therefore, it is not practical to make t1 further larger.

Thus, it is desirable to specify t1 to be as small as possible to reduce meniscus protrusion amounts in a pull-push driving system. In the driving method of the present invention, the pulse width t1 is set to no more than 1/8 of Tm. Hence, it is possible to make meniscus protrusion amounts just after droplet ejection smaller. Consequently, it is possible to improve frequency characteristics and stability characteristics of droplet ejection.

—V1 and V2—

FIGS. 10A to 13B show relationships between voltage ratios and meniscus protrusion amounts in relation to the present invention.

FIGS. 10A and 10B, 11A and 11B, 12A and 12B, and 13A and 13B are results of investigation of variations of meniscus protrusion amounts when the pulse width (t1) is fixed at 4 μs (1/10 of Tm) and a ratio between the voltage change amount V1 of the pull and the voltage change amount V2 of the push is altered.

Figure 10A:
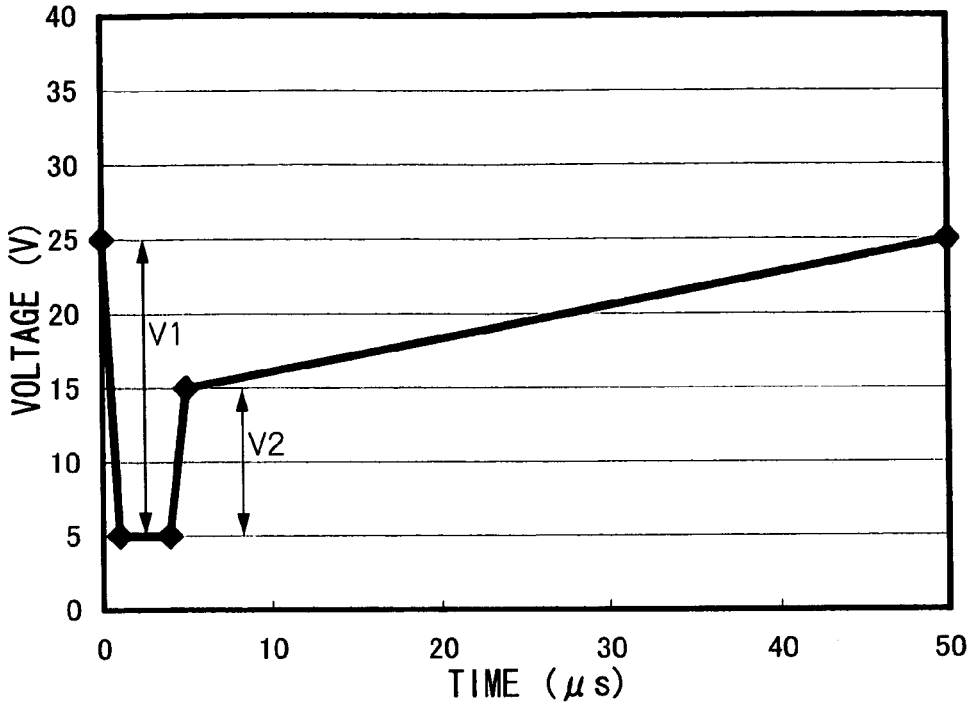
FIGS. 10A and 10B are graphs showing a relationship between a voltage ratio of a driving waveform and a meniscus protrusion amount in relation to the present invention.
Figure 10B:
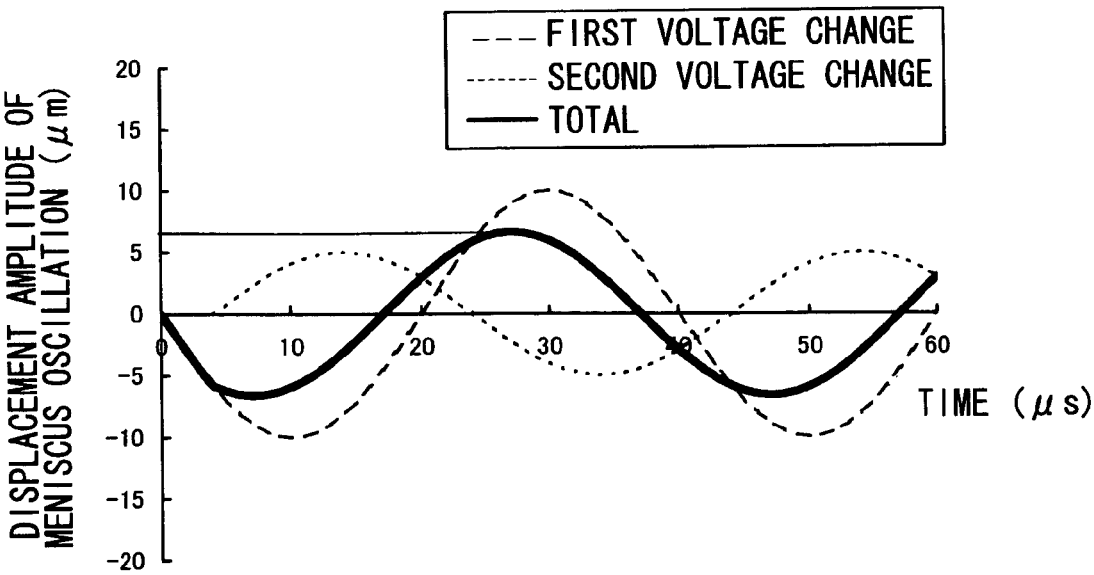
Figure 11A:
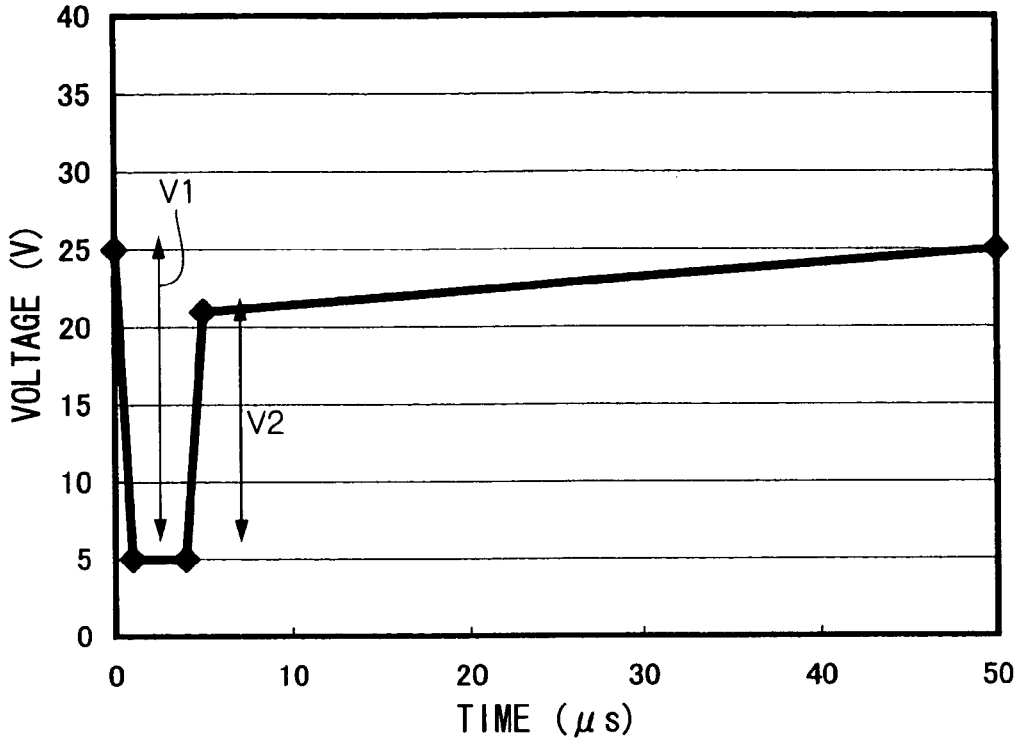
FIGS. 11A and 11B are graphs showing a relationship between a voltage ratio of a driving waveform and a meniscus protrusion amount in relation to the present invention.
Figure 11B:
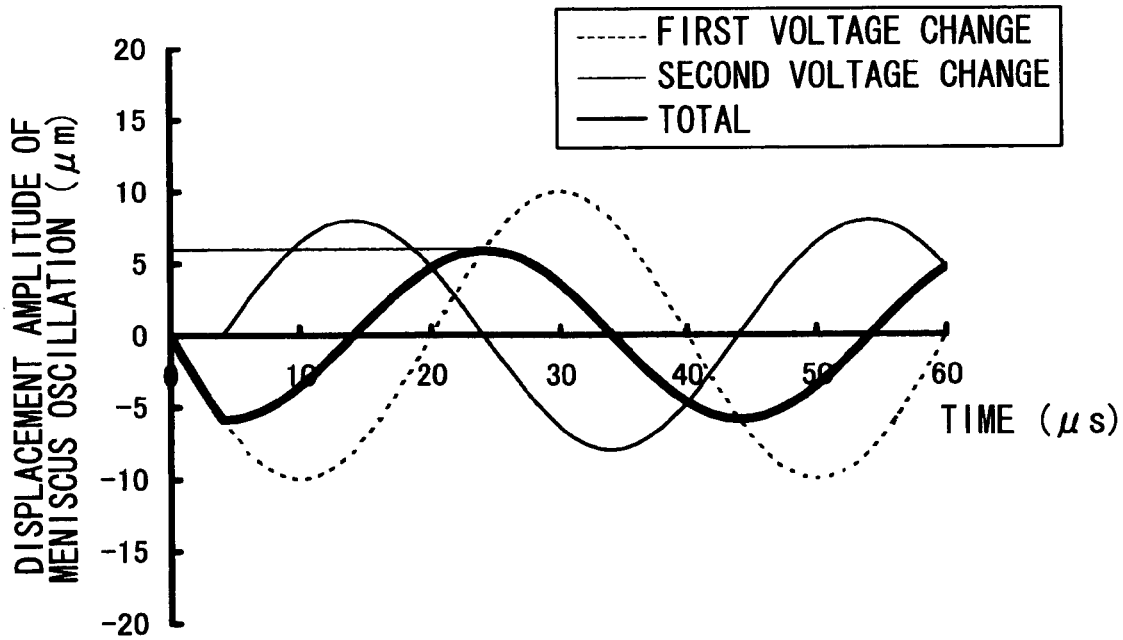
Figure 12A:
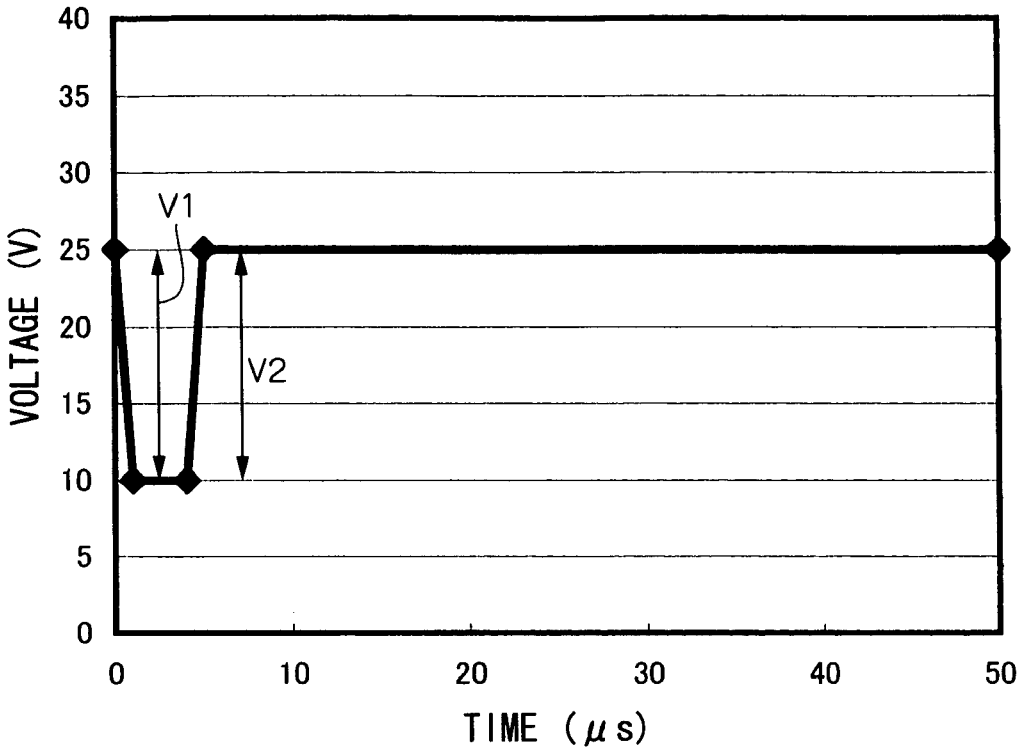
FIGS. 12A and 12B are graphs showing a relationship between a voltage ratio of a driving waveform and a meniscus protrusion amount in relation to the present invention.
Figure 12B:
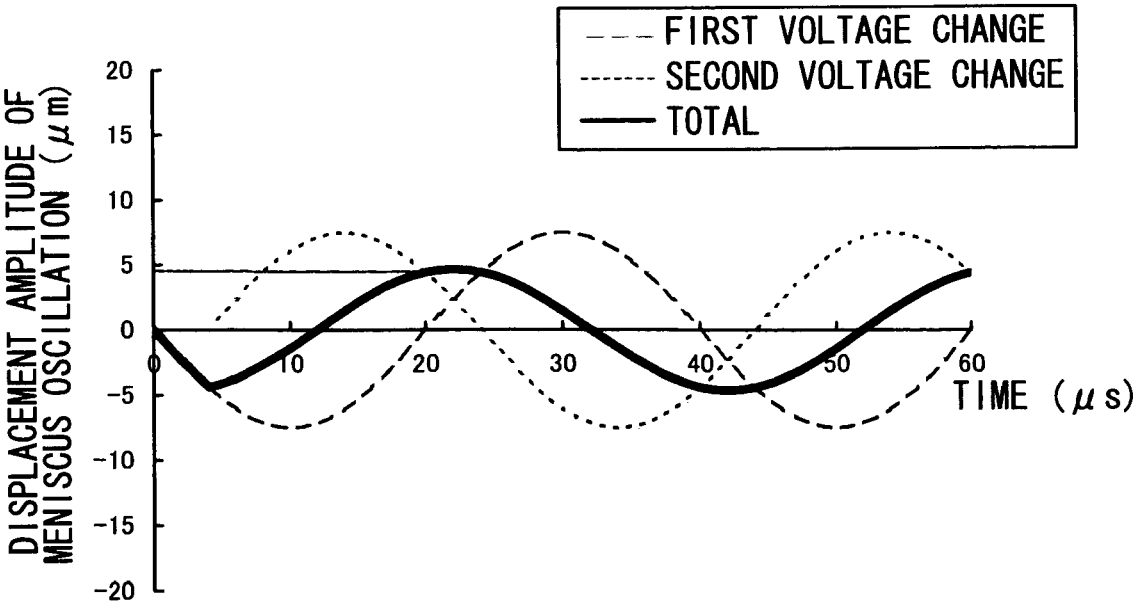
Figure 13A:
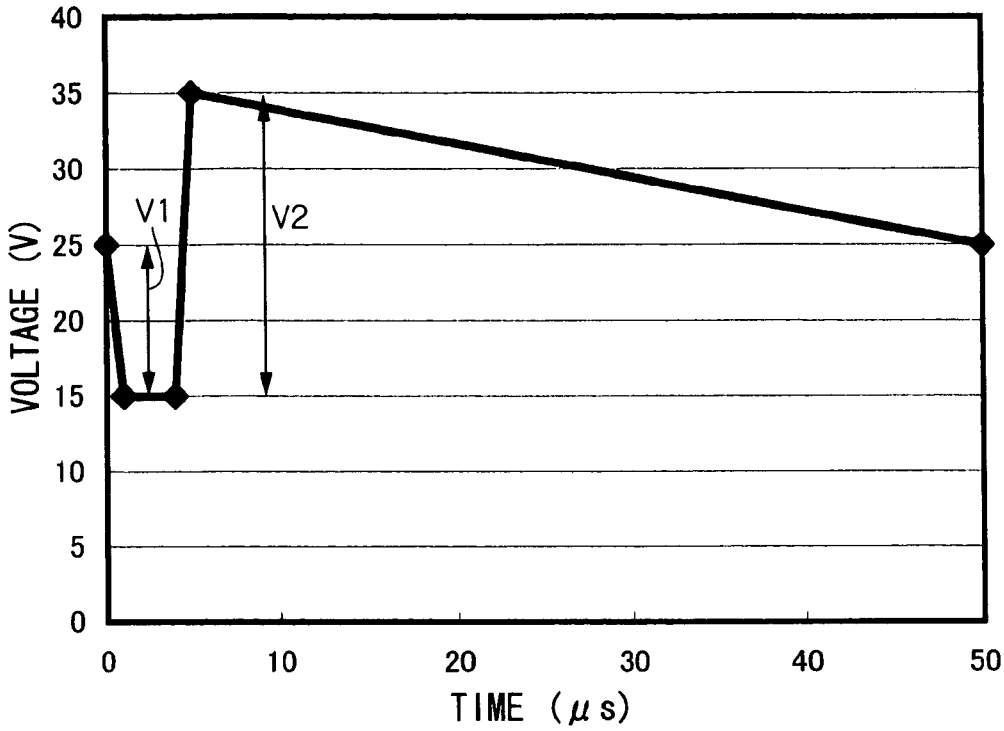
FIGS. 13A and 13B are graphs showing a relationship between a voltage ratio of a driving waveform and a meniscus protrusion amount in relation to the present invention.
Figure 13B:
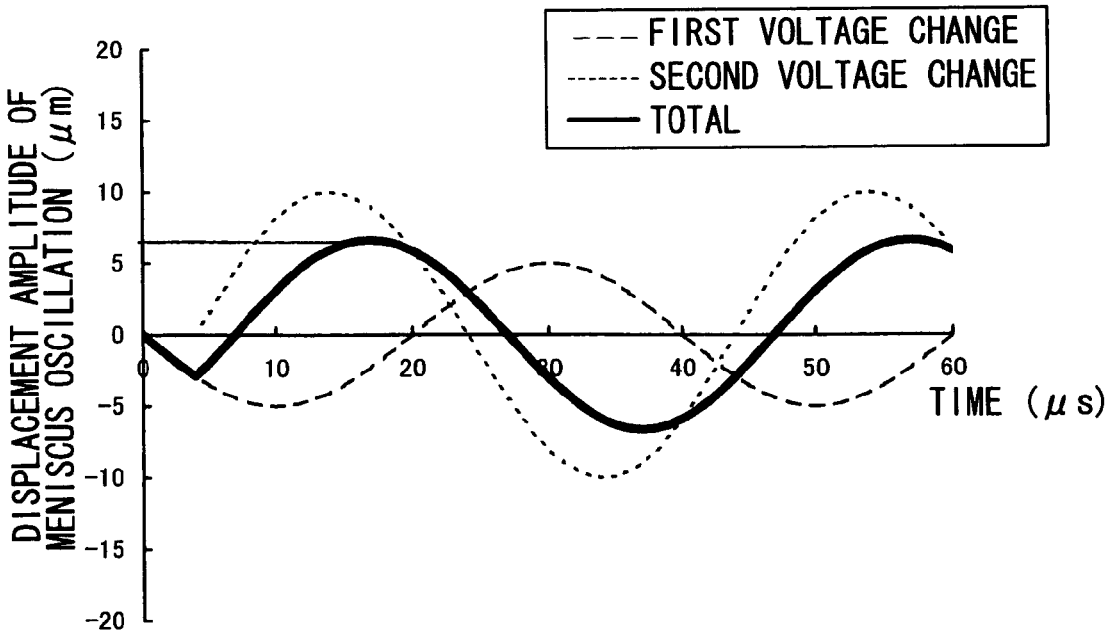

In FIGS. 10A and 10B, the ratio (V2/V1) of V1 (20 V) and V2 (10 V) is 0.5. In FIGS. 11A and 11B, the ratio of V1 (20 V) and V2 (16 V) is 0.8. In FIGS. 12A and 12B, the ratio of V1 (15 V) and V2 (15 V) is 1.0. In FIGS. 13A and 13B, the ratio of V1 (10 V) and V2 (20 V) is 2.0. Meniscus protrusion amounts are shown for these cases.

As can be seen from the results of the above, it is understood that it is possible to effectively reduce meniscus protrusion when V1 and V2 are set to be substantially the same (V2/V1=1.0), that is, in the case of FIGS. 11A and 11B.

This is because the meniscus oscillation which is excited by the pull is most effectively counteracted by the meniscus oscillation which is excited by the push when V1 and V2 are set to be substantially the same (V2/V1=1.0) and, as a result, the meniscus protrusion amount of the composite wave is made smaller. In the driving method of the present invention, the ratio (V2/V1) of V1 and V2 is set to between 0.8 and 1.2, more preferably between 0.9 and 1.1. Accordingly, it is possible to make meniscus protrusion amounts just after droplet ejection smaller.

—V1 and V3—

FIGS. 14A to 18B show relationships between voltage ratios and meniscus protrusion amounts in relation to the present invention.

Figure 14A:
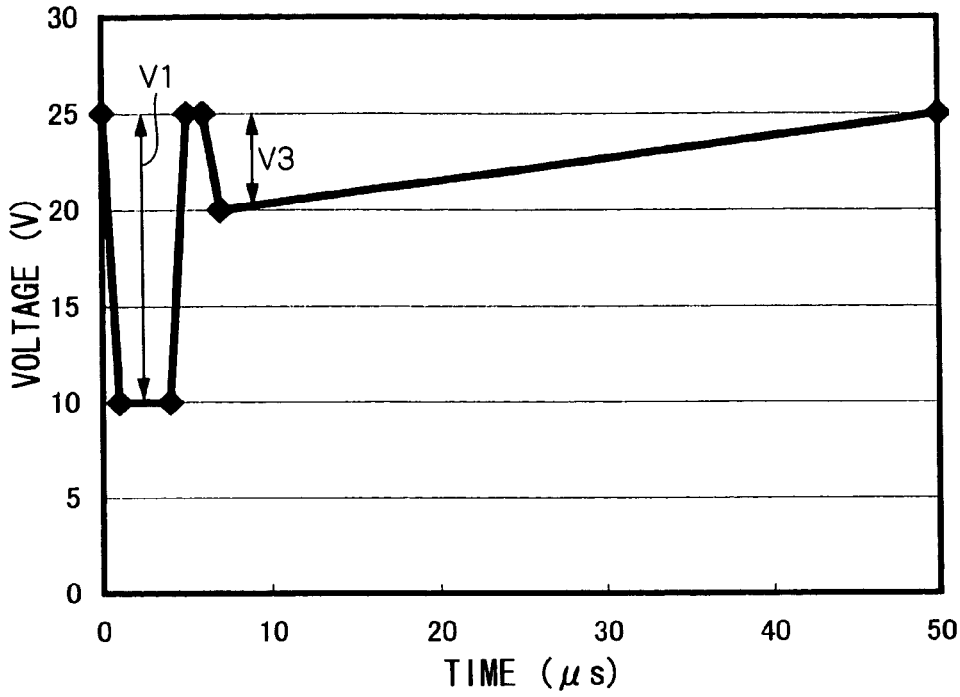
FIGS. 14A and 14B are graphs showing a relationship between a voltage ratio of a driving waveform and a meniscus protrusion amount in relation to the present invention.

FIGS. 14A and 14B, 15A and 15B, 16A and 16B, 17A and 17B, and 18A and 18B are graphs showing examples of driving waveforms for microdroplet ejection utilizing a pull-push driving system. While ejection of microdroplets can be performed by driving waveforms with single-pulse forms as shown in FIGS. 7A to 13A, if the third voltage change D3 for re-expanding the pressure generation chamber is applied just after the second voltage change D2 as shown in FIG. 14A, for a pull-push-pull form, ejection of even smaller droplets is enabled.

Figure 18A:
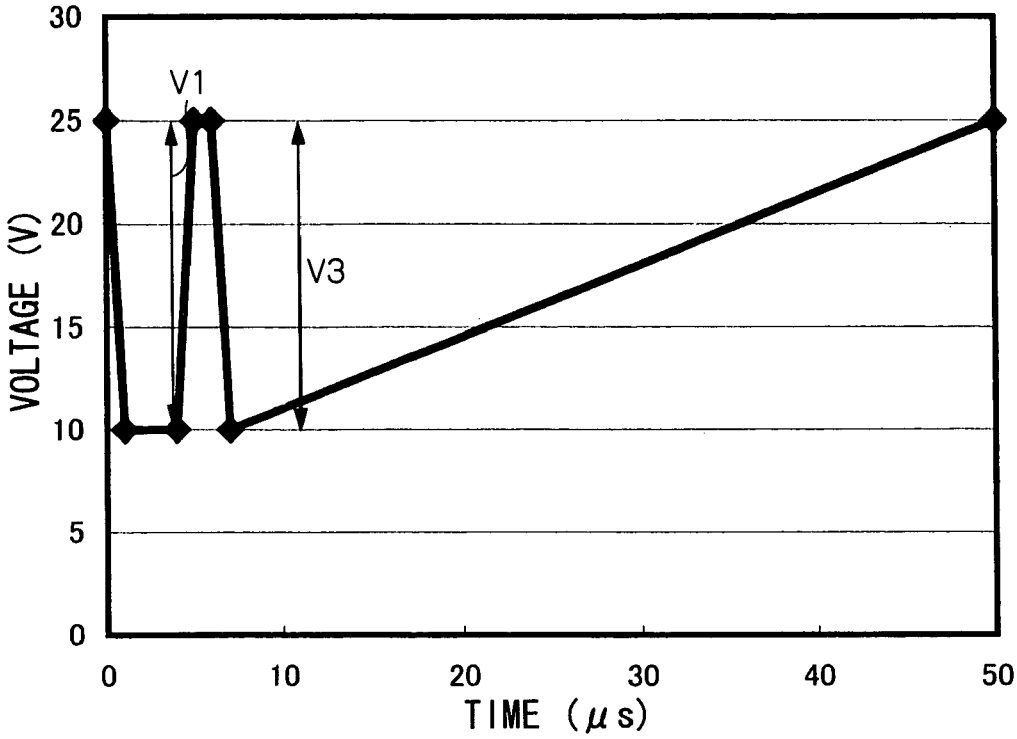
FIGS. 18A and 18B are graphs showing a relationship between a voltage ratio of a driving waveform and a meniscus protrusion amount in relation to the present invention.
Figure 18B:
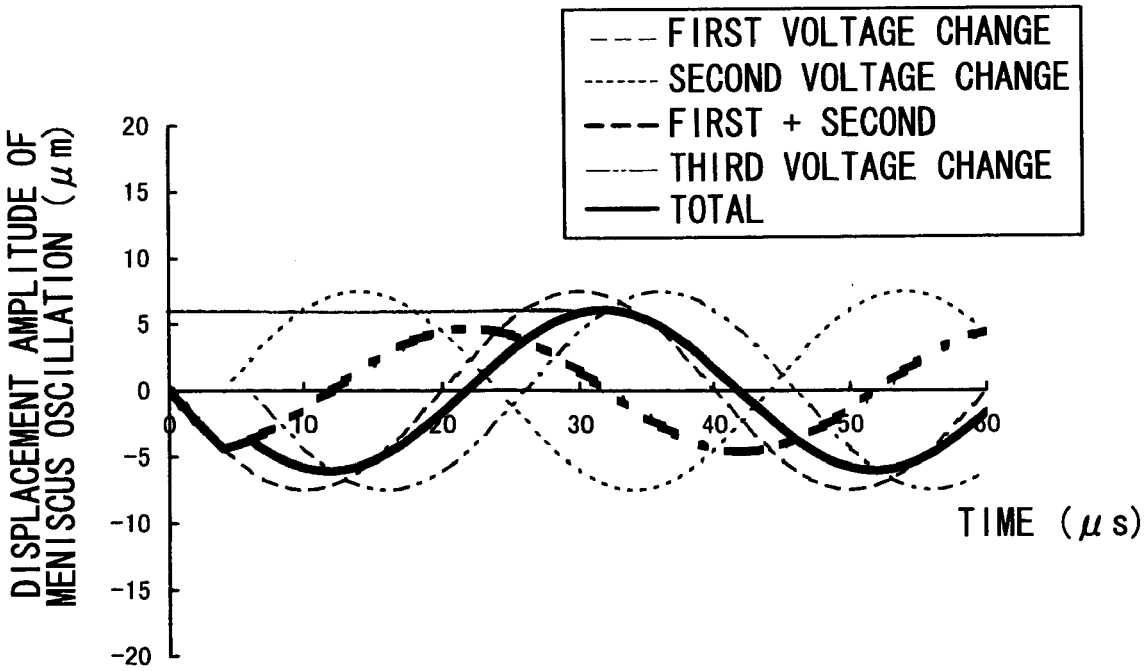

However, in such a case, because the third voltage change D3 is applied, the meniscus oscillations of the refill oscillation system are energized by this voltage change. Consequently, there is a problem in that meniscus protrusion just after droplet ejection is increased. If, for example, the voltage change V3 of the third voltage change D3 is equal to the voltage change amount V2 of the second voltage change D2 as shown in FIGS. 18A and 18B (V1:V3=1:1), meniscus protrusion occurs as shown in FIG. 18B.

Figure 14B:
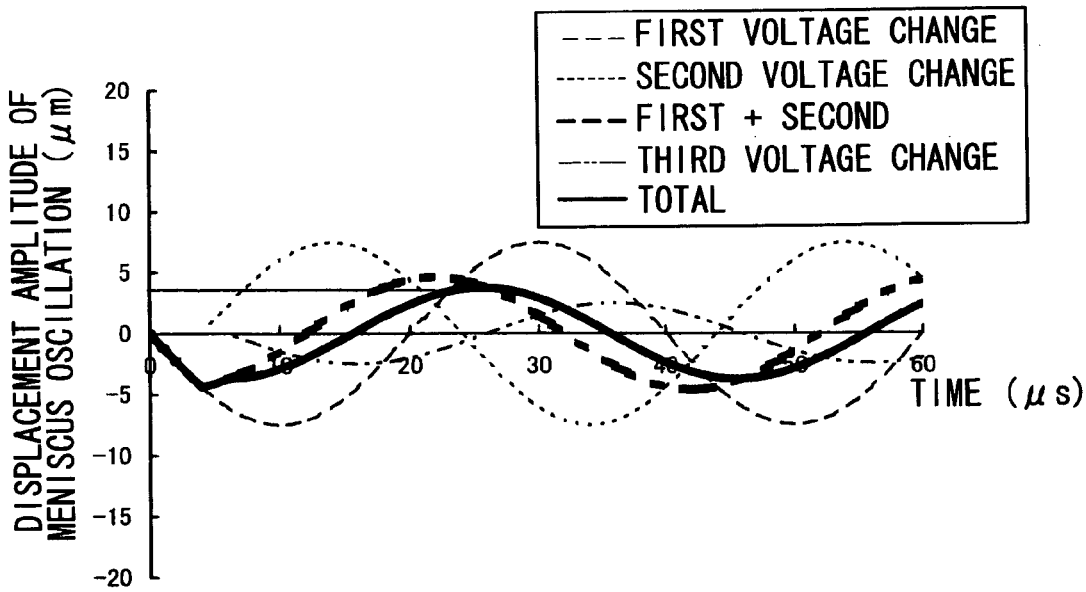
Figure 15A:
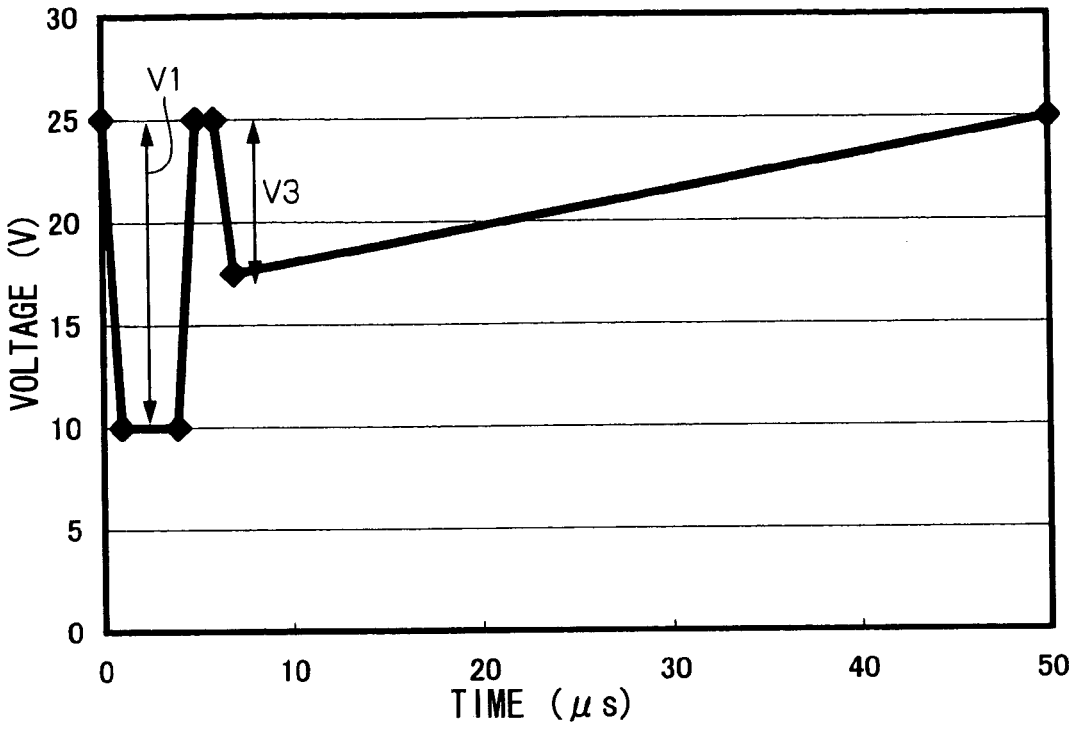
FIGS. 15A and 15B are graphs showing a relationship between a voltage ratio of a driving waveform and a meniscus protrusion amount in relation to the present invention.
Figure 15B:
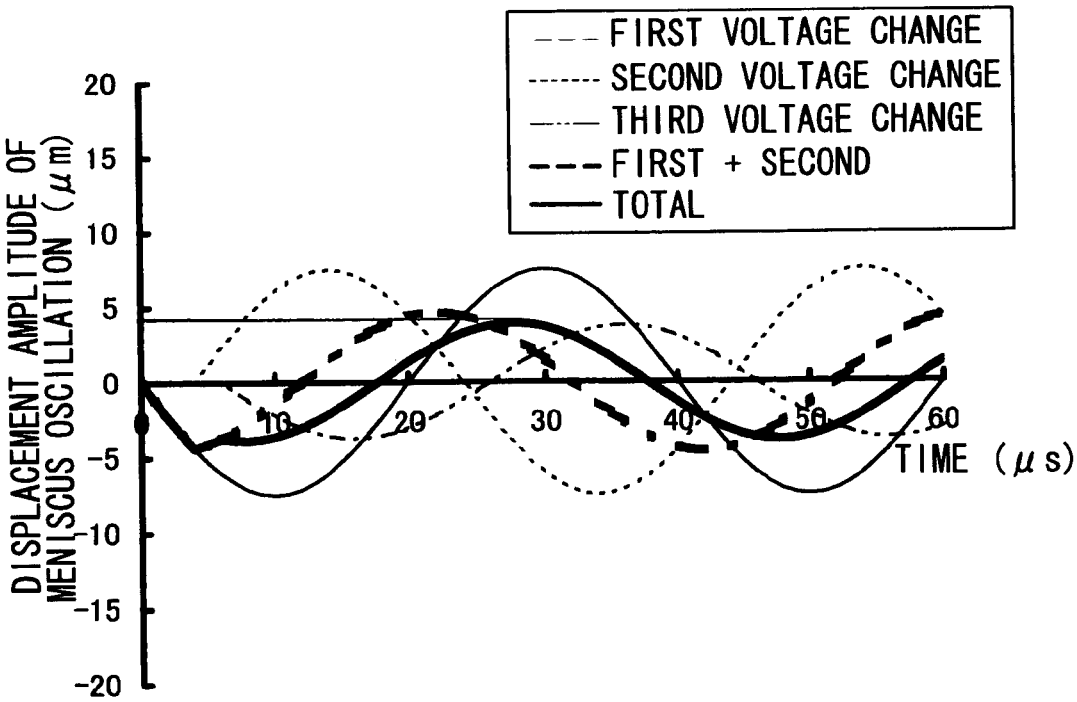

In contrast, if the voltage change amount V3 of the third voltage change D3 is set to be smaller, as shown in FIG. 14A (V1:V3=3:1), it is possible to prevent an increase in meniscus protrusion, as shown in FIG. 14B. However, in this case it will be difficult to obtain a sufficient effect for reducing sizes of the droplets that are ejected.

The present invention, by specifying the voltage change amount V3 of the third voltage change D3 to between 0.5 times (see FIGS. 15A and 15B) and 0.8 times (see FIGS. 17A and 17B) the voltage change amount V2 of the second voltage change D2, can suppress an increase in meniscus protrusion amounts while assuring a satisfactory droplet miniaturization effect.

Figure 16A:
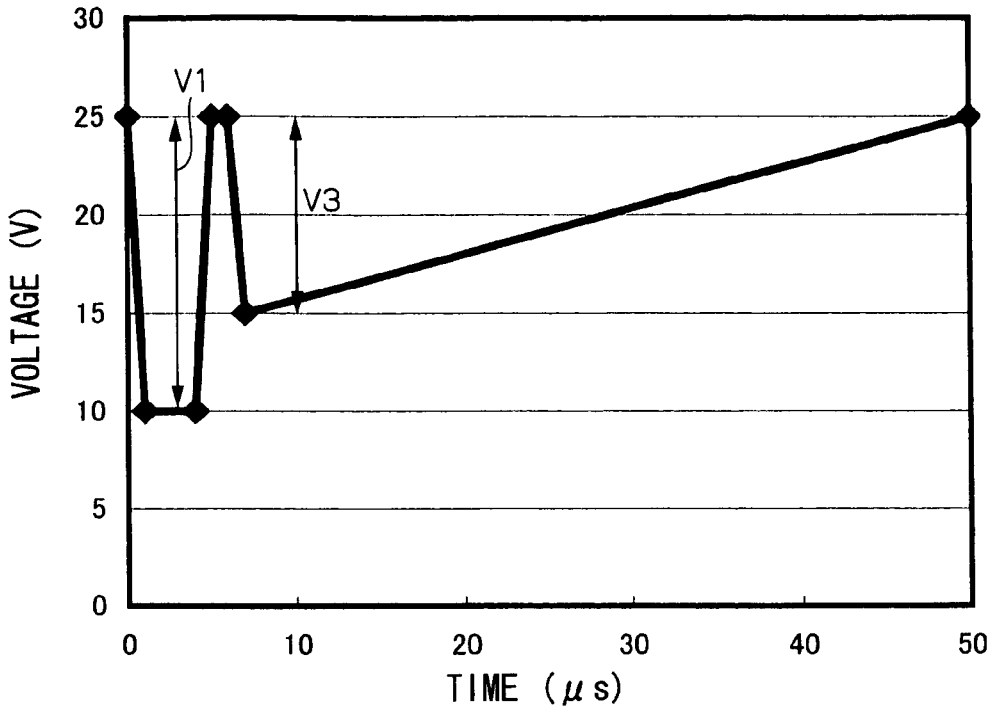
FIGS. 16A and 16B are graphs showing a relationship between a voltage ratio of a driving waveform relating to the present invention and a meniscus protrusion amount.
Figure 16B:
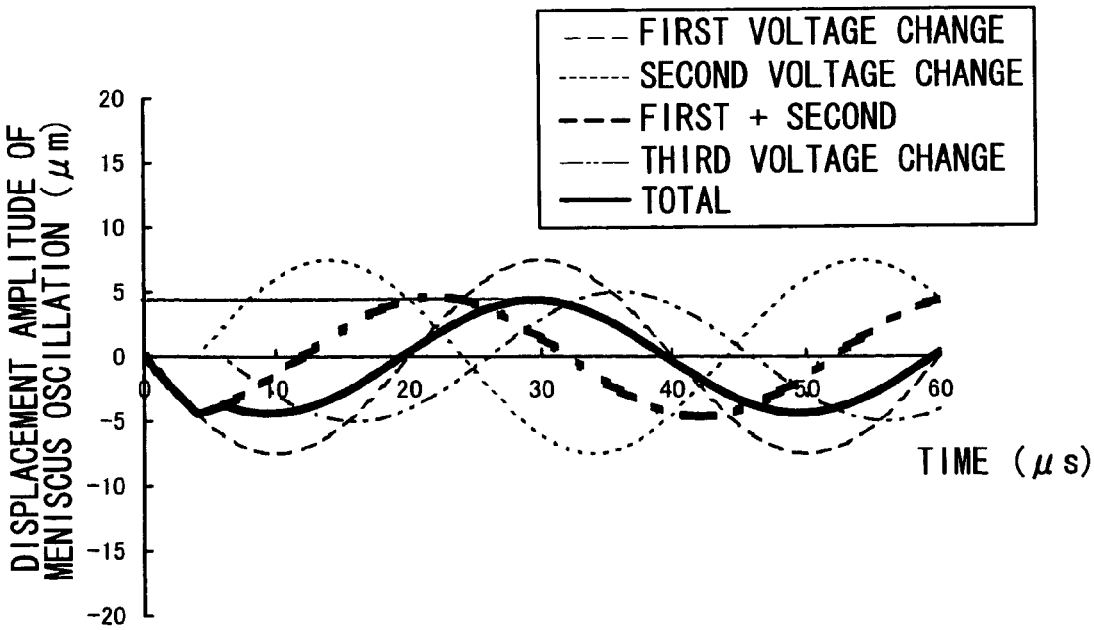
Figure 17A:
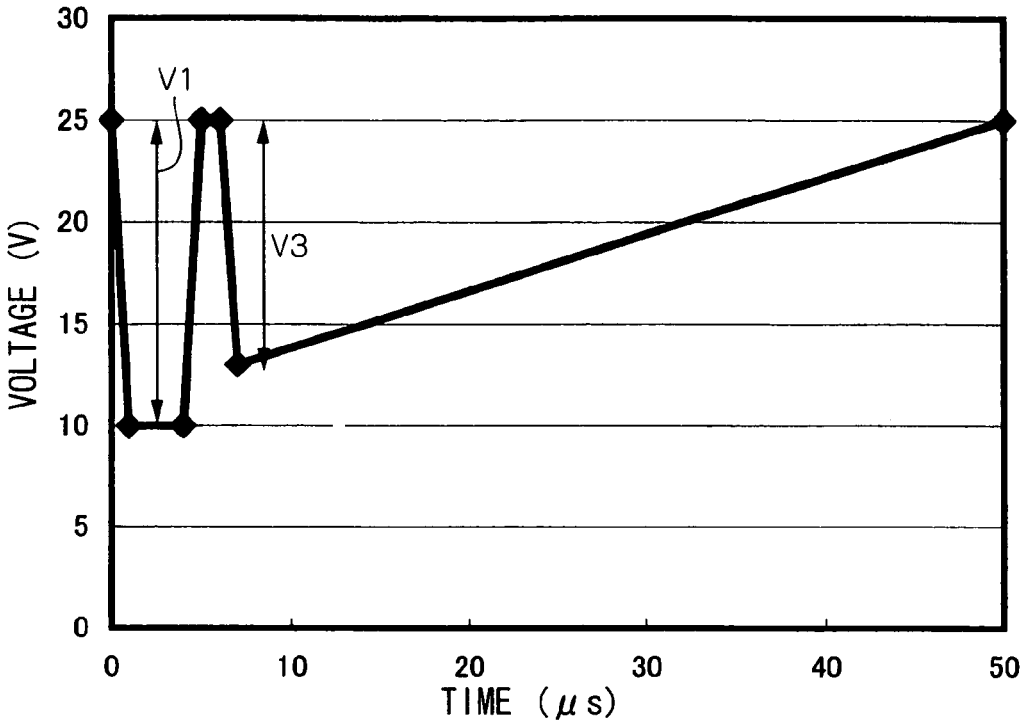
FIGS. 17A and 17B are graphs showing a relationship between a voltage ratio of a driving waveform and a meniscus protrusion amount in relation to the present invention.
Figure 17B:
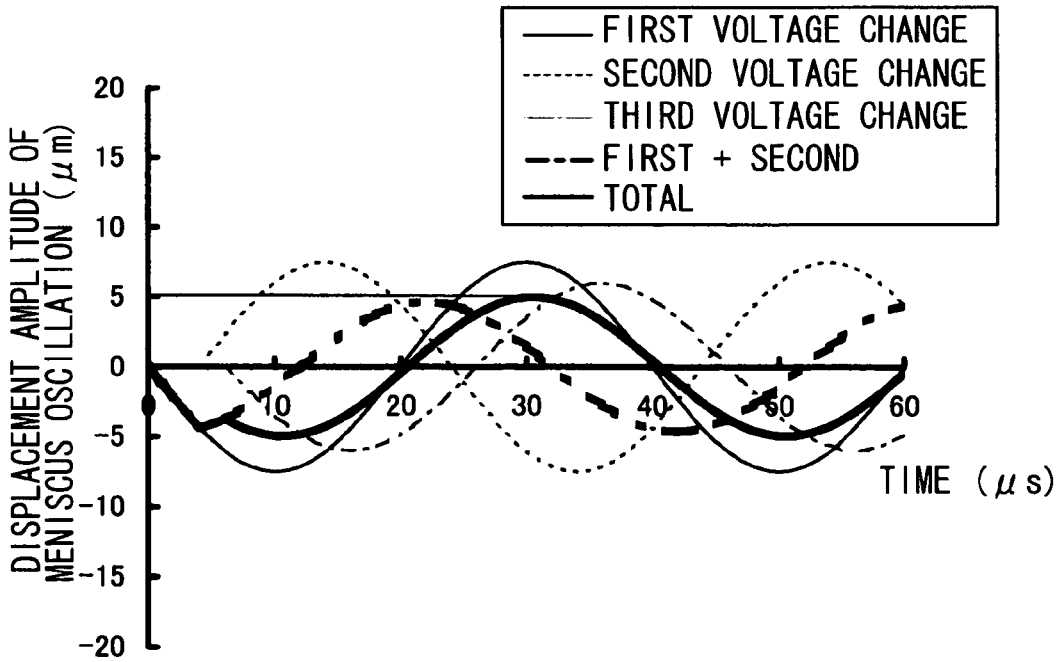

Thus, if the voltage change amount V3 of the third voltage change D3 is set to between 0.5 and 0.8 times the voltage change amount V2 as shown in FIG. 16A (here, V1:V3=3:2), then, as shown in FIG. 16B, it is both possible to prevent an increase in meniscus protrusion and possible to obtain a satisfactory effect with regard to reducing droplet sizes of the droplets that are ejected.

—Pulse Interval and Tm—

FIGS. 19A to 21B show relationships between pulse widths and meniscus protrusion amounts in relation to the present invention.

FIGS. 19A and 19B, 20A and 20B, and 21A and 21B are graphs showing other examples of driving waveforms for microdroplet ejection utilizing a pull-push driving system. These examples feature the inclusion of a fourth voltage change D4, for compressing the pressure generation chamber, after the third voltage change D3, with a view to reducing droplet size. The object of this fourth voltage change D4 is to suppress reverberation of a pressure wave which is generated at the time of droplet ejection. Hence, it is possible to improve ejection stability characteristics at a time of high frequency ejections.

However, when this fourth voltage change D4 is applied, meniscus oscillations of the refill oscillation system are energized by the fourth voltage change D4, and consequently there is a problem in that meniscus protrusion just after droplet ejection increases.

Figure 21A:
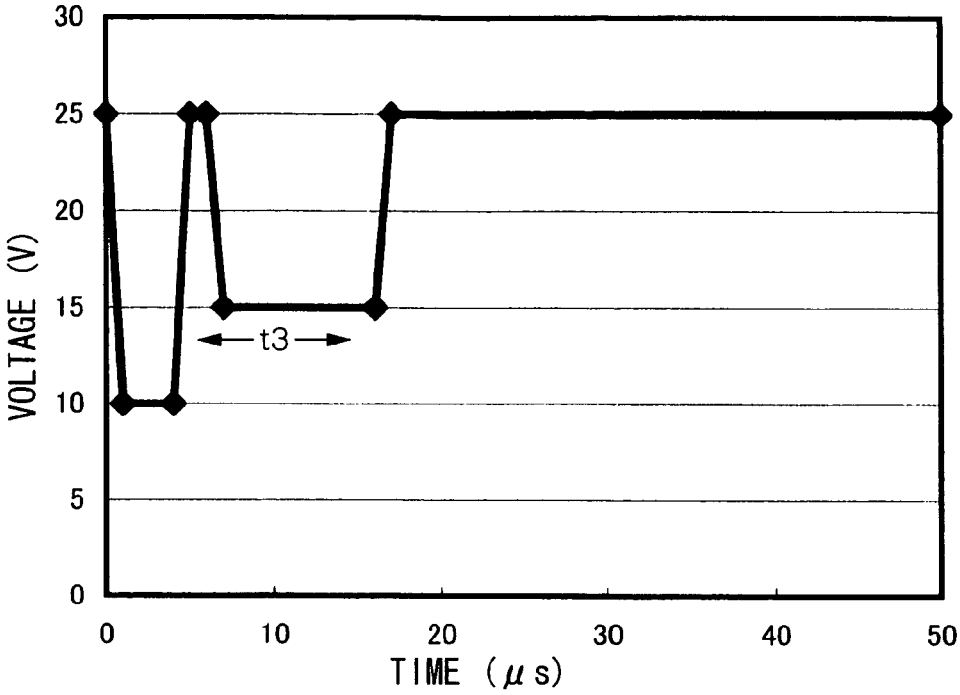
FIGS. 21A and 21B are graphs showing a relationship between a pulse interval of a driving waveform and a meniscus protrusion amount in relation to the present invention.
Figure 21B:
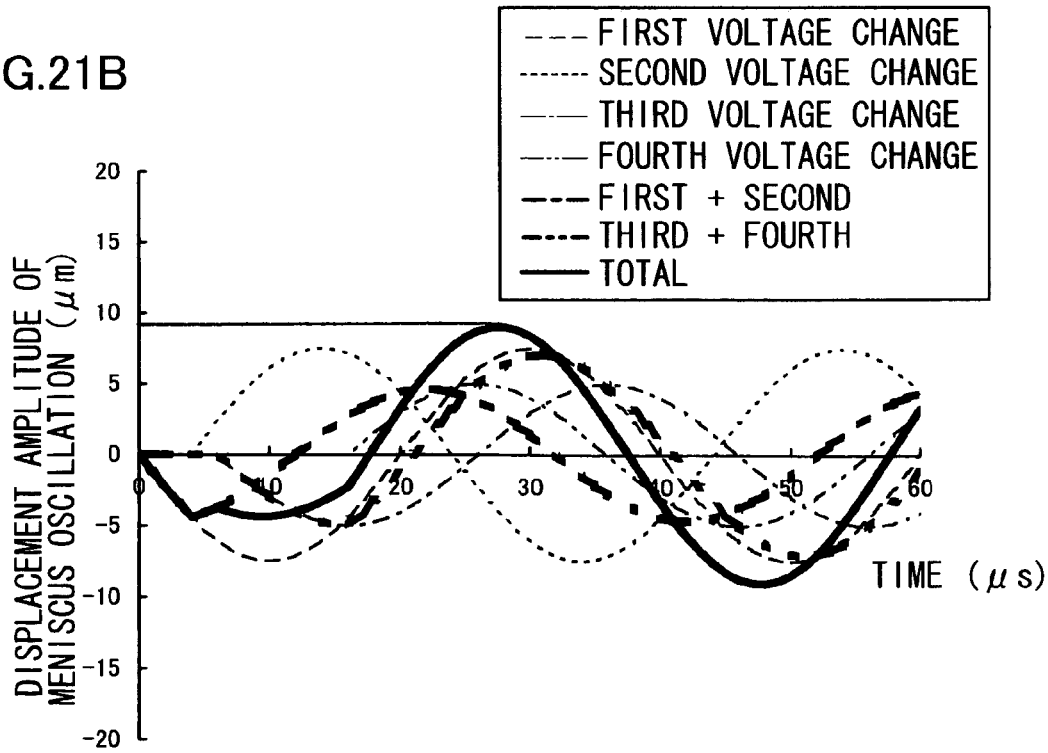

In particular, as shown in FIGS. 21A and 21B, when an interval t3 between the third voltage change D3 and the fourth voltage change D4 is larger (10 μs in this case), meniscus oscillations of the refill oscillation system are amplified, and a large meniscus protrusion occurs just after droplet ejection.

The present invention, by specifying the interval between the third voltage change and the fourth voltage change to be no more than 1/10 of the resonance period Tm of the refill oscillations, causes the meniscus oscillations that are energized by the third voltage change D3 and the fourth voltage change D4 to counteract, and enables a reduction in a meniscus protrusion amount just after droplet ejection.

That is, if t3 is large as shown in FIGS. 21A and 21B (t3/Tm=1/4), the meniscus oscillation of the refill oscillation system that is excited by the fourth voltage change D4 is compounded with the meniscus oscillation of the refill oscillation system that is generated in the time before the third voltage change D3, and a meniscus protrusion amount just after droplet ejection is even larger.

Figure 20A:
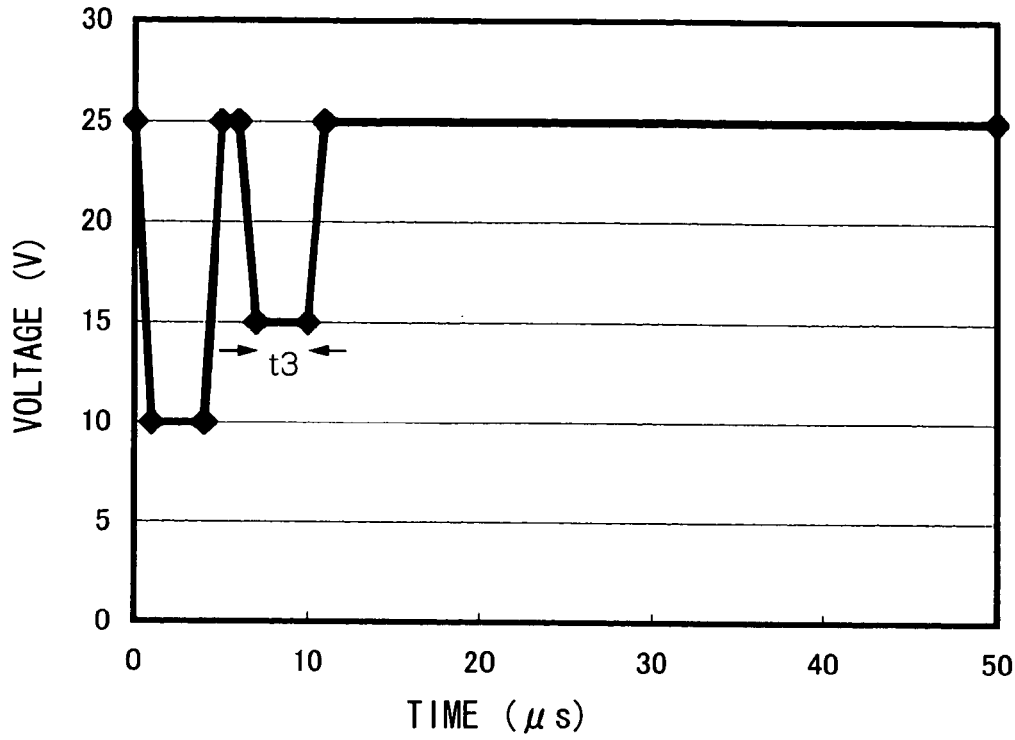
FIGS. 20A and 20B are graphs showing a relationship between a pulse interval of a driving waveform and a meniscus protrusion amount in relation to the present invention.
Figure 20B:
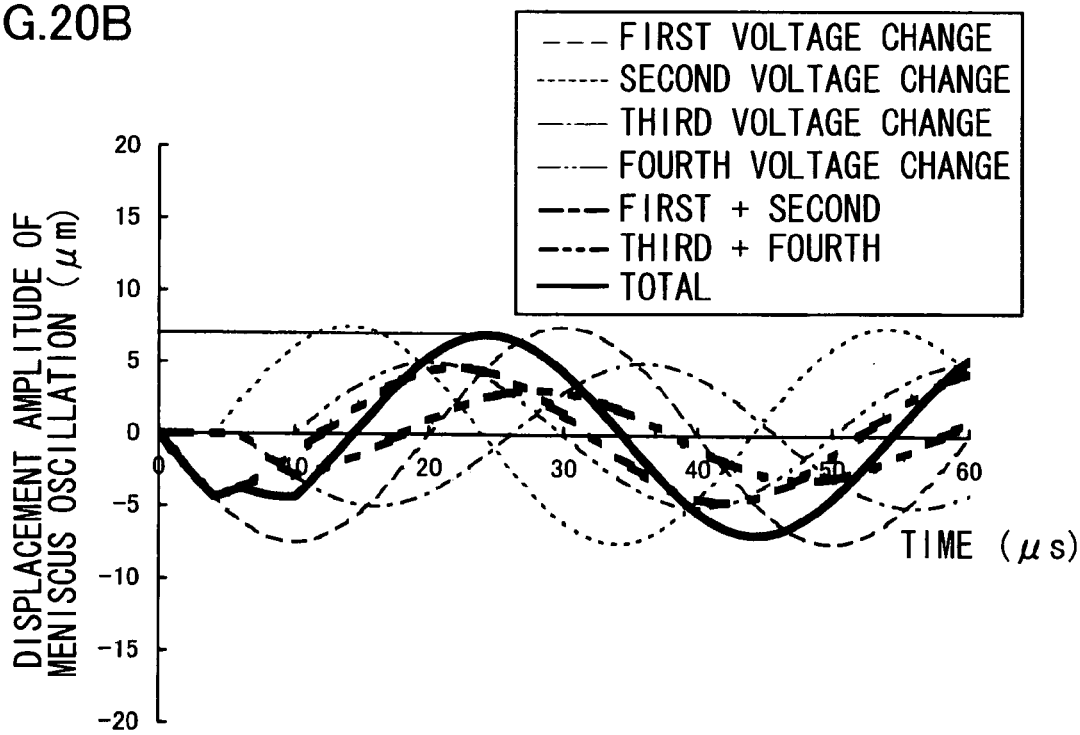

When t3 is small as shown in FIGS. 20A and 20B (t3/Tm=1/10), the meniscus protrusion amount just after droplet ejection, subsequent to addition of the meniscus oscillation of the refill oscillation system that is excited by the fourth voltage change D4, is suppressed to be approximately equivalent to the meniscus protrusion amount caused by the first and second voltage changes.

Figure 19A:
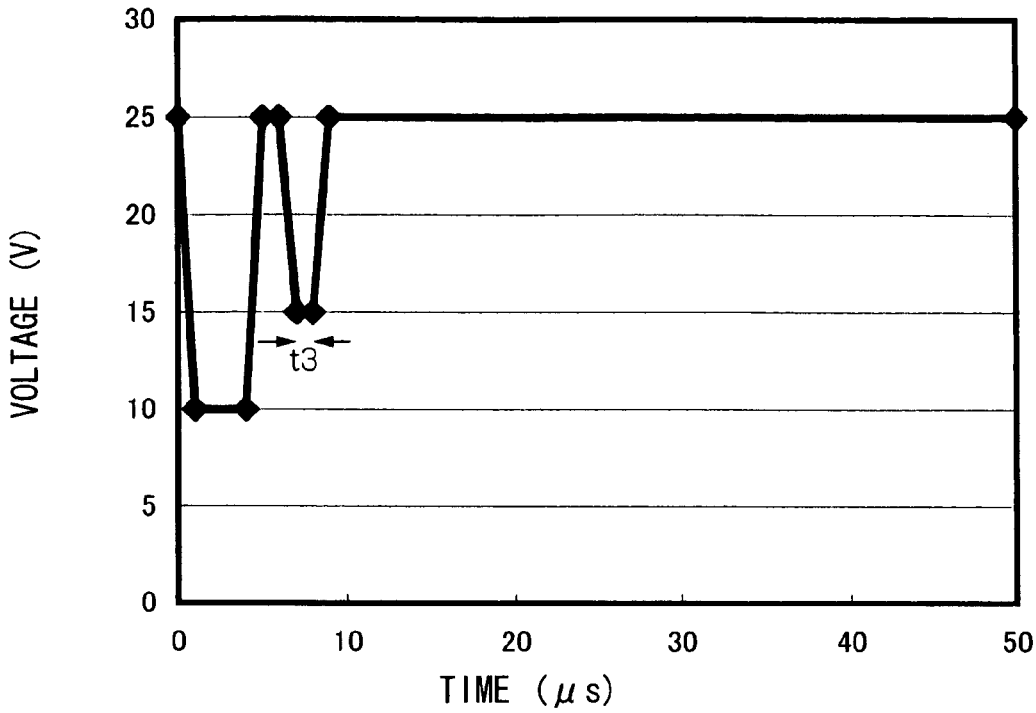
FIGS. 19A and 19B are graphs showing a relationship between a pulse interval of a driving waveform and a meniscus protrusion amount in relation to the present invention.
Figure 19B:
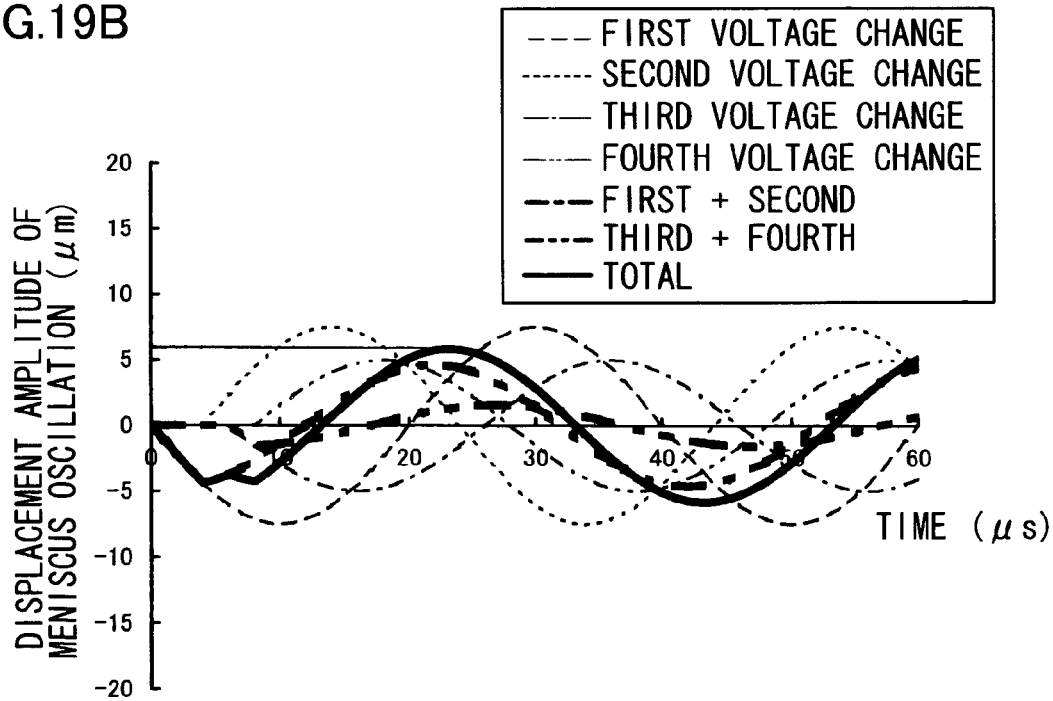

Further, when t3 is even smaller as shown in FIGS. 19A and 19B (t3/Tm=1/20), the meniscus protrusion amount just after droplet ejection, subsequent to addition of the meniscus oscillation of the refill oscillation system that is excited by the fourth voltage change D4, is suppressed to a level even lower than the meniscus protrusion amount caused by the first and second voltage changes.

As described above, by specifying the interval t3 between the third voltage change D3 and the fourth voltage change D4 to be no more than 1/10 of the resonance period Tm of the refill oscillations, the meniscus oscillations that are energized by the third voltage change D3 and the fourth voltage change D4 are counteracted and, while meniscus protrusion amounts just after droplet ejection are reduced, reverberation of the pressure wave generated at the time of droplet ejection is suppressed, and thus it is possible to improve ejection stability characteristics at times of high frequency ejections.

—V3 and V4—

FIGS. 22A to 26B show relationships between voltage ratios and meniscus protrusion amounts in relation to the present invention.

FIGS. 22A and 22B, 23A and 23B, 24A and 24B, 25A and 25B, and 26A and 26B are graphs showing further examples of driving waveforms for microdroplet ejection utilizing a pull-push driving system. Similarly to the examples shown in FIGS. 19A to 21B, these examples feature the inclusion of the fourth voltage change D4 for compressing the pressure generation chamber after the third voltage change D3, with a view to reducing droplet size. The object of the fourth voltage change D4 is to suppress reverberation of the pressure wave which is generated at the time of droplet ejection. Hence, as mentioned earlier, it is possible to improve ejection stability characteristics at a time of high frequency ejections.

However, when this fourth voltage change D4 is applied, meniscus oscillations of the refill oscillation system are energized by the fourth voltage change D4, and consequently there is a problem in that meniscus protrusion just after droplet ejection increases.

Figure 26A:
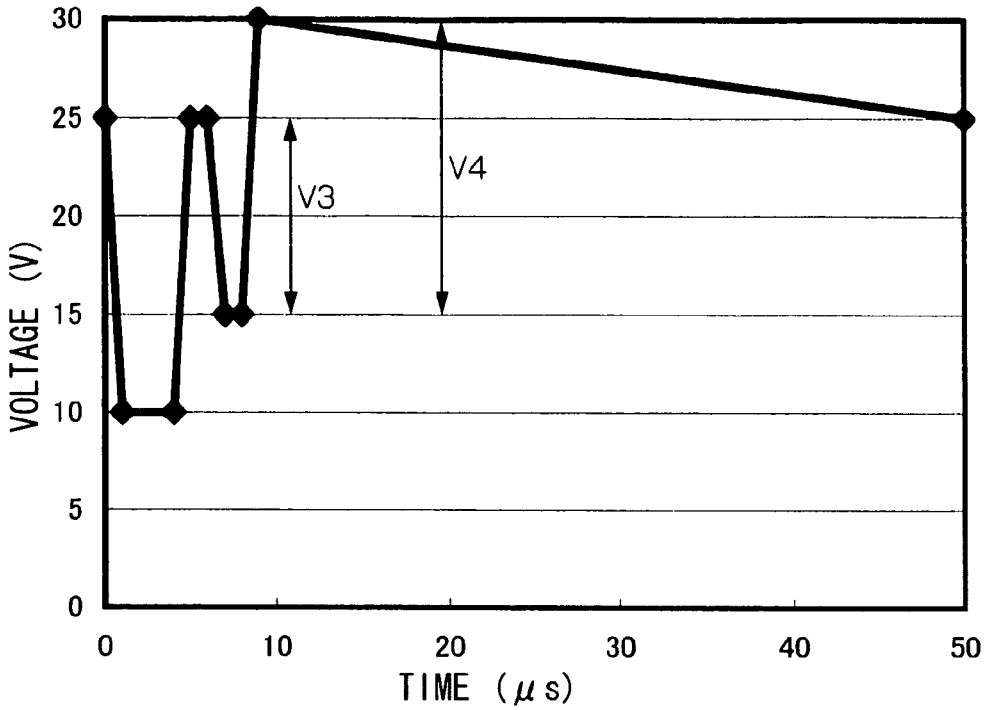
FIGS. 26A and 26B are graphs showing a relationship between a voltage ratio of a driving waveform and a meniscus protrusion amount in relation to the present invention.
Figure 26B:
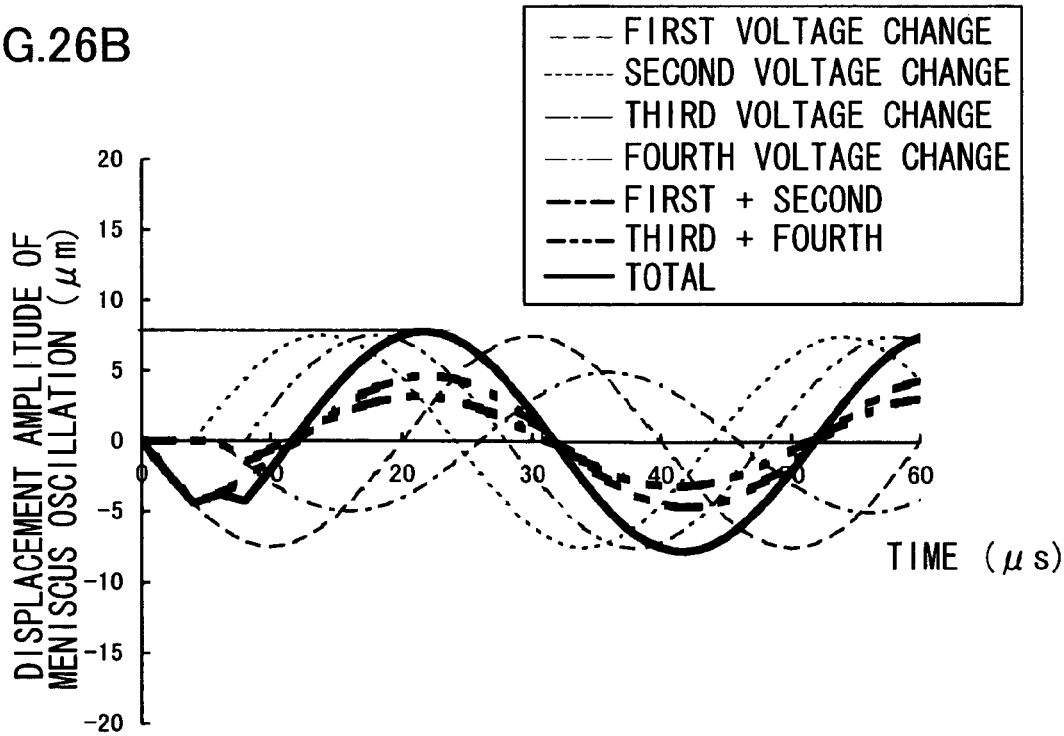

If the voltage change amount V4 of the fourth voltage change D4 is set to be large, for example, as shown in FIGS. 26A and 26B (V3:V4=10:15), meniscus oscillations of the refill oscillation system are amplified, and a large meniscus protrusion occurs just after droplet ejection.

Figure 22A:
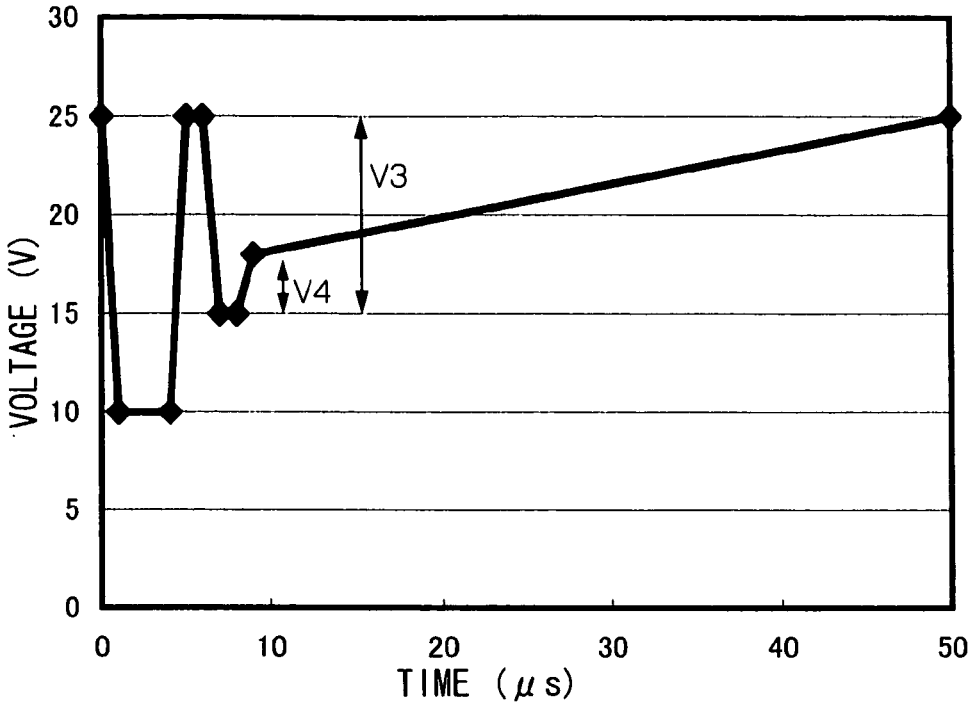
FIGS. 22A and 22B are graphs showing a relationship between a voltage ratio of a driving waveform and a meniscus protrusion amount in relation to the present invention.
Figure 22B:
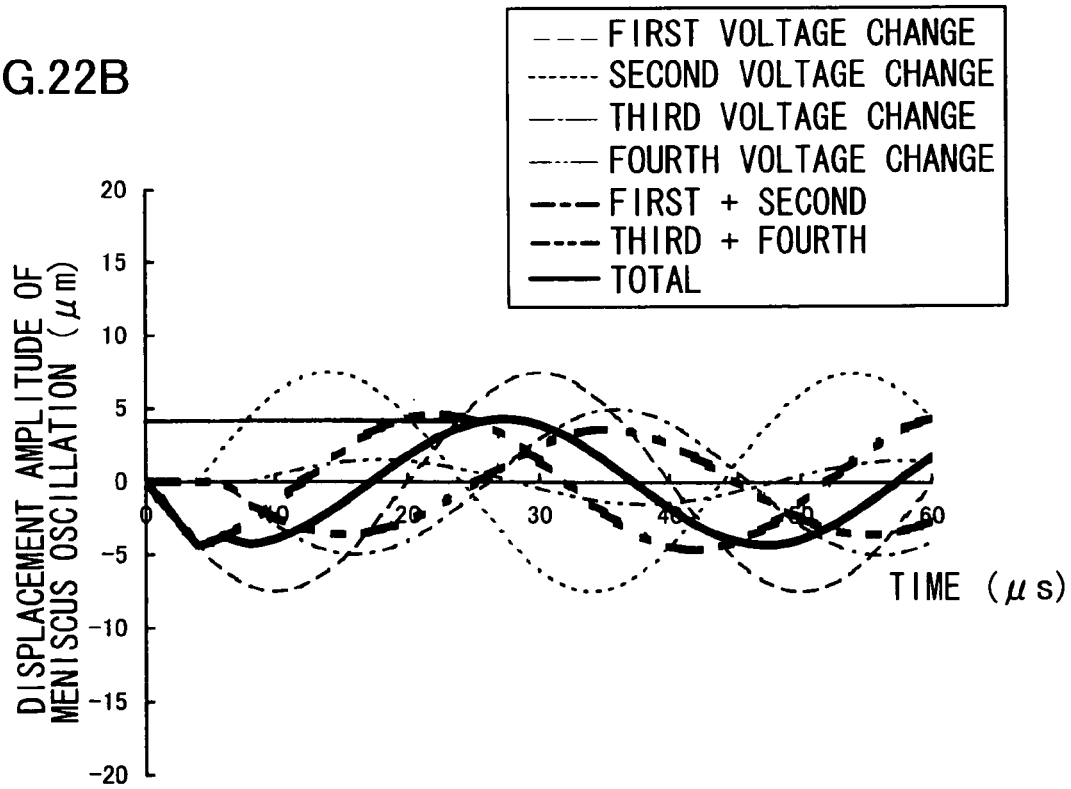
Figure 23A:
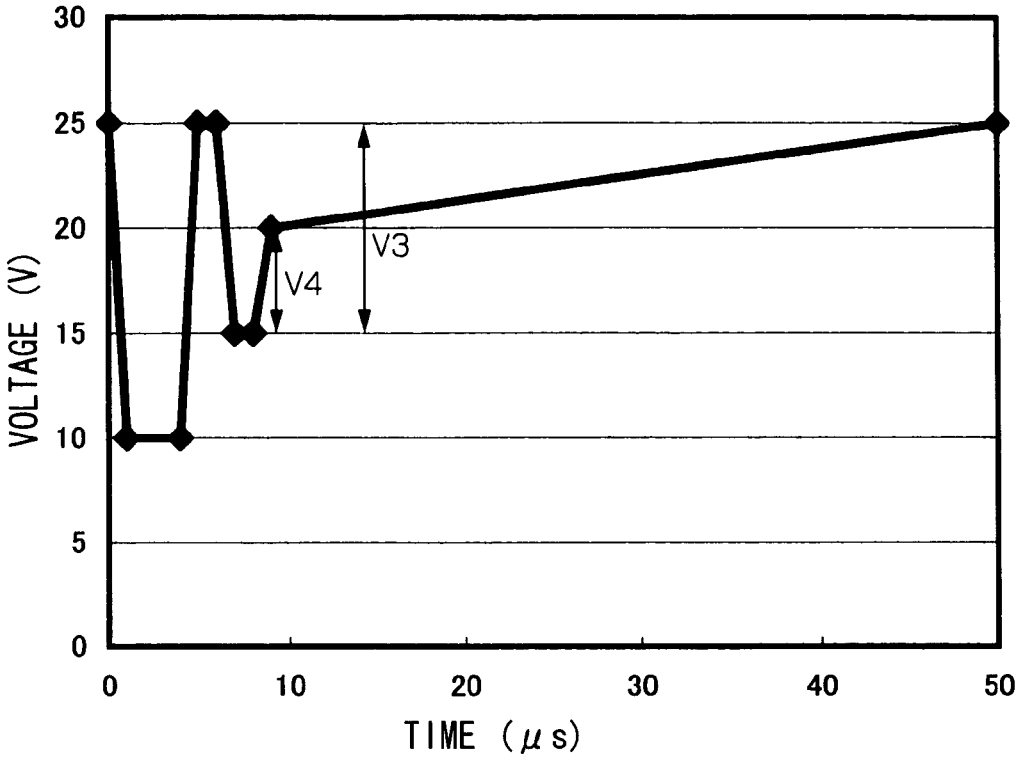
FIGS. 23A and 23B are graphs showing a relationship between a voltage ratio of a driving waveform and a meniscus protrusion amount in relation to the present invention.
Figure 23B:
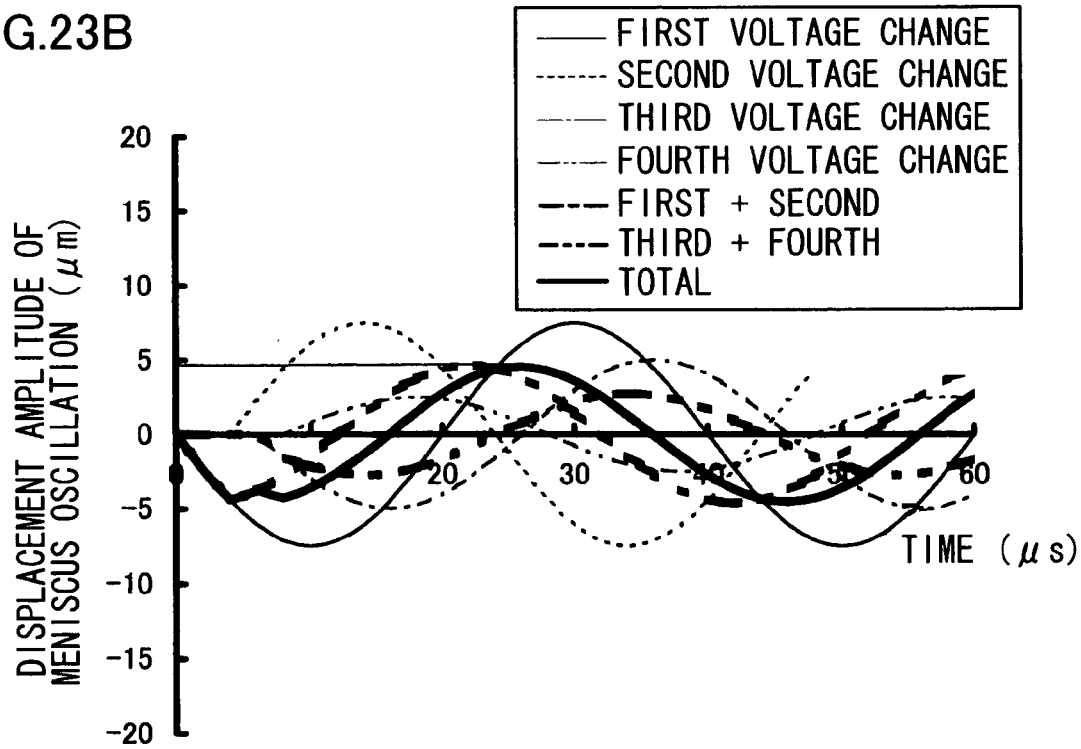

In contrast, if the voltage change amount V4 of the fourth voltage change D4 is set to be small as shown in FIGS. 22A and 22B (V3:V4=10:3), it is possible to prevent an increase in the meniscus protrusion, as shown in FIG. 22B, and if V4 is set to be very small, it is possible to obtain a pressure wave reverberation suppression effect.

The present invention, by specifying the voltage change amount V4 of the fourth voltage change D4 to be between 0.5 times (see FIGS. 23A and 23B) and 0.8 times (see FIGS. 25A and 25B) the voltage change amount V3 of the third voltage change D3, can suppress an increase in meniscus protrusion amounts while assuring a satisfactory reverberation suppression effect.

Figure 24A:
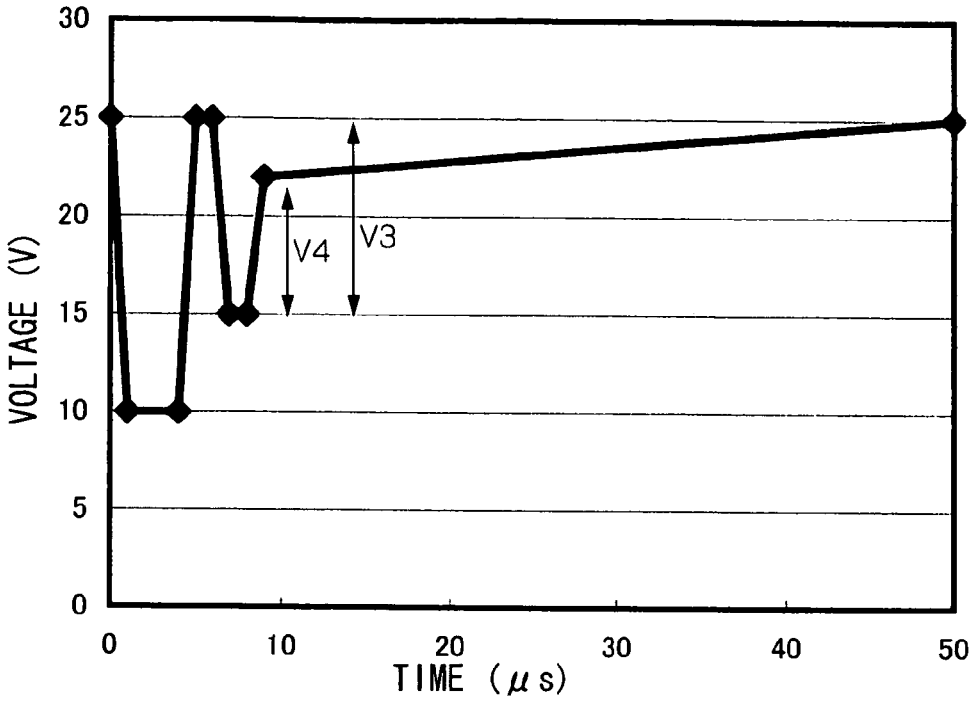
FIGS. 24A and 24B are graphs showing a relationship between a voltage ratio of a driving waveform and a meniscus protrusion amount in relation to the present invention.
Figure 24B:
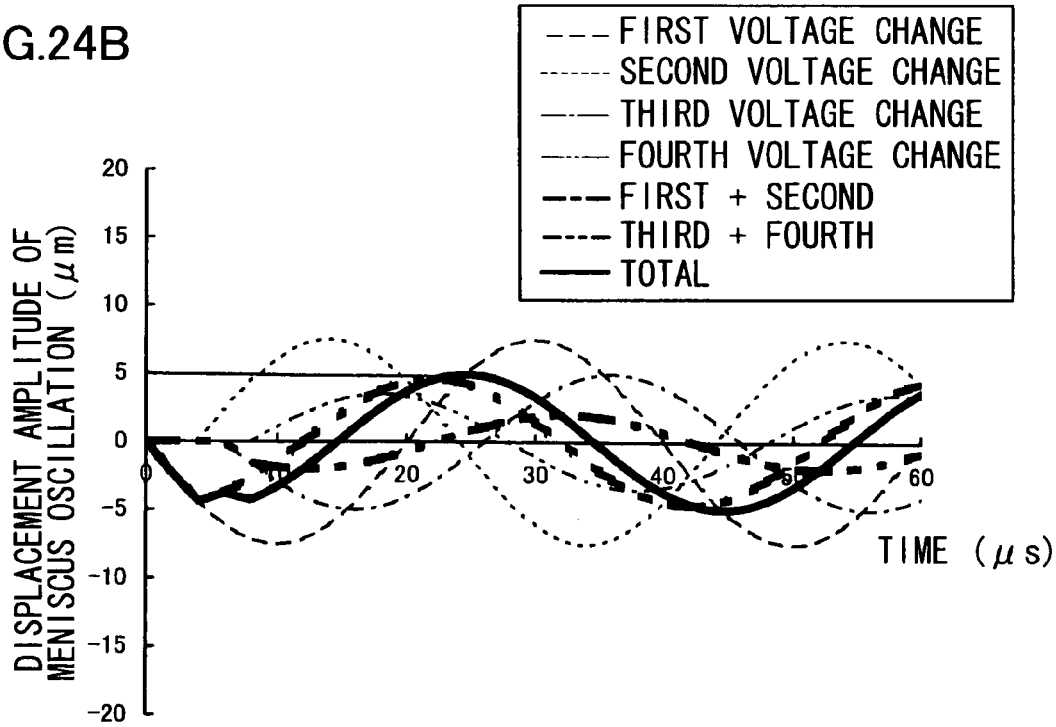
Figure 25A:
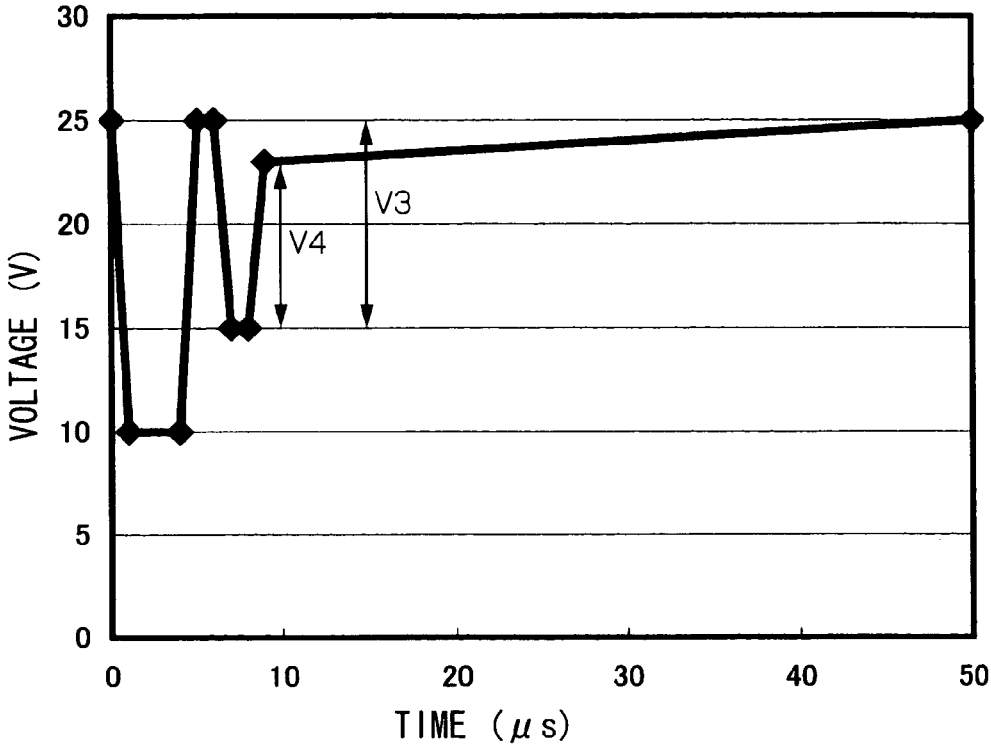
FIGS. 25A and 25B are graphs showing a relationship between a voltage ratio of a driving waveform and a meniscus protrusion amount in relation to the present invention.
Figure 25B:
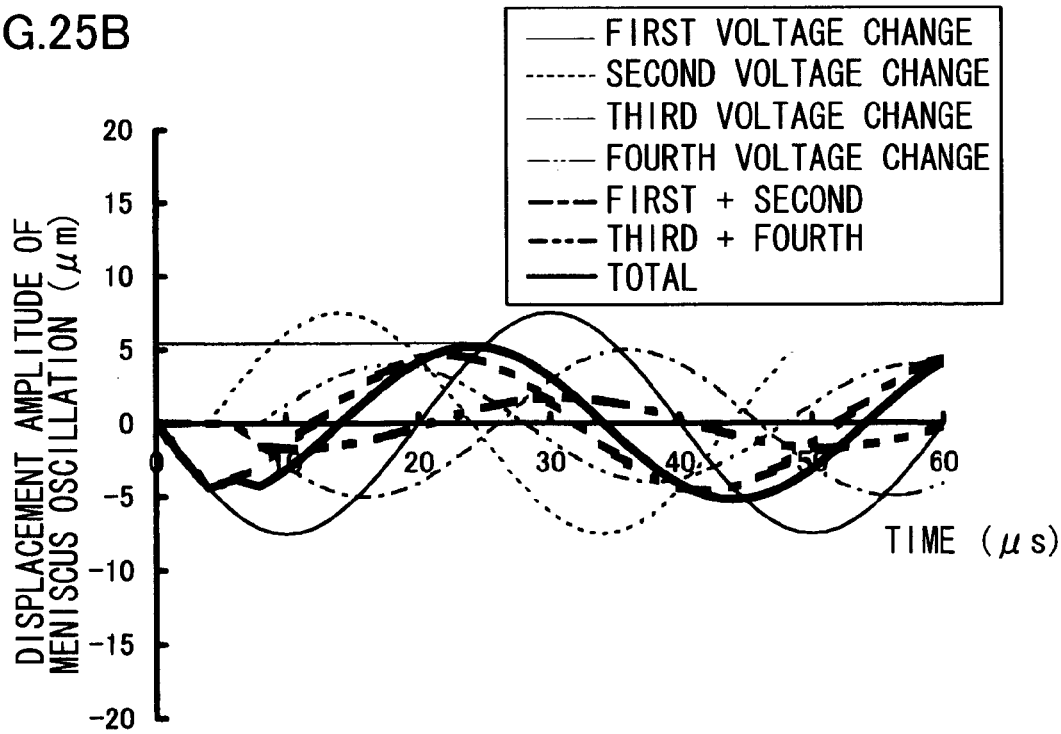

Thus, if the voltage change amount V4 of the fourth voltage change D4 is set to between 0.5 and 0.8 times V3 as shown in FIG. 24A (here, V3:V4=10:7), then, as shown in FIG. 24B, it is possible to prevent an increase in meniscus protrusion, and a satisfactory pressure wave reverberation suppression effect can be obtained.

—Tm and Tc—

As described above, in order to eject microdroplets with small droplet volumes stably at high frequencies, a driving waveform as shown in FIG. 24A (=FIG. 1A) is most suitable.

Now, in the above descriptions, the time intervals of the voltage changes D1 to D4 have been prescribed on the basis of the resonance period Tm of the refill oscillations. However, in order to implement the basic function of a droplet ejection head, efficiently ejecting droplets, it is necessary to maintain suitable relationships between the time intervals of the voltage changes D1 to D4 and the resonance period Tc of the pressure waves.

Specifically, setting the time interval between the first voltage change D1 (the pull) and the second voltage change D2 (the push) to approximately ½ of Tc is important for improving ejection efficiency. Accordingly, in the droplet ejection head of the present invention, Tc is set at not more than ¼ of Tm. As a result, it is possible to simultaneously realize suppression of meniscus protrusions and assurance of ejection efficiency.

That is, it is possible for the time interval t1 between the first voltage change D1 (the pull) and the second voltage change D2 (the push) to simultaneously satisfy the two conditions $t1<\frac{1}{8}\cdot Tm$ and $t1\approx\frac{1}{2}\cdot Tc$.

—Design of Driving Waveform—

The driving waveform shown in FIG. 1A is similar to driving waveforms which have been conventionally disclosed as basic forms. However, the design concept greatly differs from conventionally described driving waveforms in that the time intervals between the voltage changes D1 to D4 are specified with reference to the resonance period Tm of the refill oscillations.

Figure 27A:
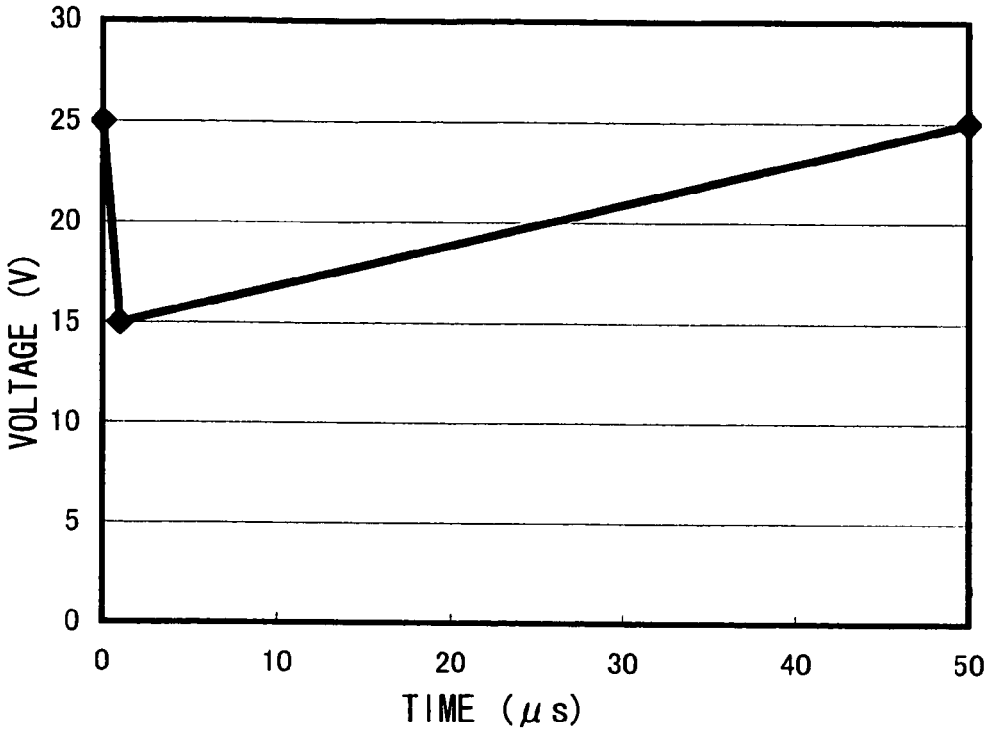
FIGS. 27A and 27B are graphs showing a method for calculating a resonance period of a refill oscillation system in relation to the present invention.
Figure 27B:
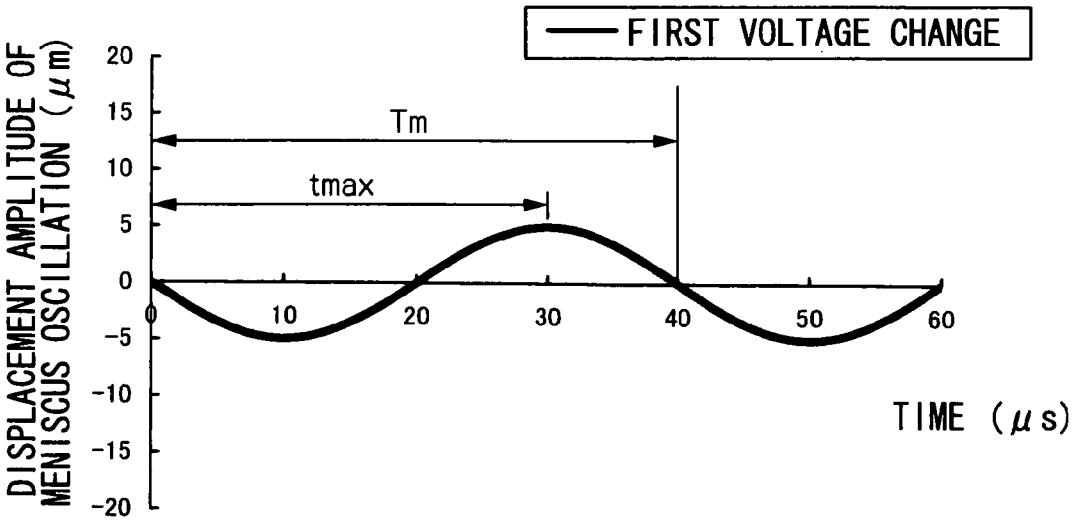

It is possible to find the resonance period Tm of the refill oscillations by applying the driving waveform shown in FIG. 27A and determining a time (tmax) at which the meniscus 12 is most protruded from the nozzle 10 by stroboscopic observation or the like, with $Tm=4/3\cdot Tmax$. Further, it is possible to find the resonance period Tc of the pressure waves by applying the driving waveform shown in FIG. 27A and measuring meniscus protrusions with a laser doppler instrument or the like.

—Conclusions—

As has been described above, when a driving waveform of the present invention is employed, a meniscus protrusion just after ejection can be suppressed to be extremely small. For example, with the driving waveform shown in FIG. 1A, even though the driving waveform has a complex form including the first to fourth voltage changes D1 to D4, a meniscus protrusion amount just after droplet ejection is cut down to about 5 μm. With a conventional driving waveform, as shown in FIG. 28B, a meniscus amount of 10 μm or more occurs. In comparison therewith, it can be seen that a meniscus protrusion amount just after droplet ejection can be greatly reduced with the driving waveform of the present invention.

Because, as described above, it is possible to reduce a meniscus protrusion amount just after droplet ejection with a driving waveform of the present invention, it is resultantly possible to improve frequency characteristics and ejection stability characteristics of droplet ejection.

It has been experimentally confirmed that with, for example, the driving waveform shown in FIG. 1A, stable ejection of microdroplets with 2 μl droplet volumes at high frequencies such as 20 kHz is possible. The stable ejection referred to here means that variations so large as to affect image quality do not arise in droplet volumes and speeds, emission directions, and states of occurrence of satelliting (microdroplets around the droplets). For example, in a frequency range from 1 to 20 kHz, an amount of variation in droplet speeds is ±0.5 m/s, which is small.

Figure 28A:
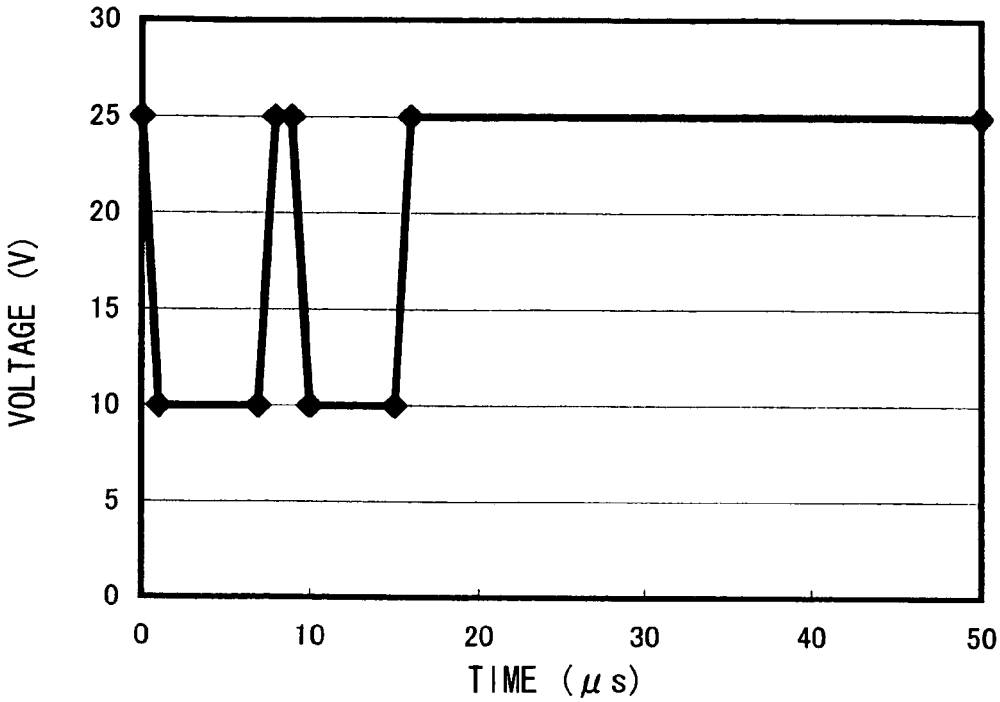
FIGS. 28A and 28B are graphs showing a driving waveform of a conventional droplet ejection head.
Figure 28B:
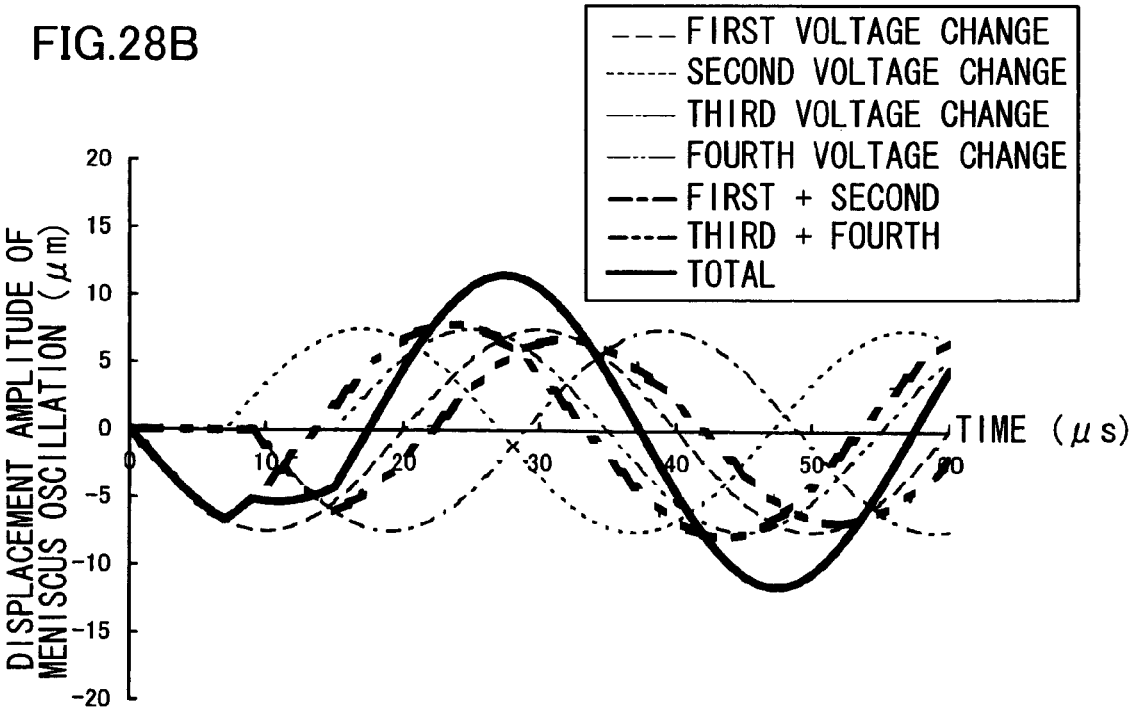

In contrast, in a case in which the conventional driving waveform of FIGS. 28A and 28B is employed, in a frequency region from 7 kHz upward, there are large variations in droplet volumes, speeds, and states of occurrence of satelliting. At frequencies from 16 kHz upward, ejection failures occur due to wetting of a nozzle face (face flooding).

Because, as described above, a driving waveform relating to the present invention can suppress meniscus protrusions just after droplet ejection, a great improvement in frequency characteristics and stability characteristics of droplet ejections (particularly ejections of microdroplets) is enabled. Accordingly, it is possible to set a high driving frequency while maintaining stable ejection characteristics, and thus it is possible to efficiently improve processing capabilities of a device as a whole.

—Other Points—

Hereabove, an example of the present invention has been described. However, the present invention is in no way limited to the example described above. Obviously, various modes can be realized within a scope not deviating from the spirit of the present invention.

For example, the fluid to be ejected is not limited to ink. A droplet ejection head driving waveform of the present invention can be utilized for general droplet jetting devices which are employed in industry, such as, for example, fabricating color filters for displays by ejecting droplets onto polymer films, glass and the like, forming bumps for mounting of components by ejecting liquid solder onto substrates, and so forth.

What is claimed is:

1. A droplet ejection head driving method, which applies a driving voltage waveform to pressure-generating means for pressurizing fluid in a pressure chamber and ejecting a droplet, wherein the driving voltage waveform includes, a first voltage change process, which expands the pressure chamber, and a second voltage change process, which shrinks the pressure chamber, after the first voltage change process, and wherein a time interval between the first voltage change process and the second voltage change process is not more than ⅛ of a resonance period Tm of a meniscus oscillation, which is a refill oscillation which is governed by surface tension of the fluid at a nozzle portion.

2. The droplet ejection head driving method of claim 1, wherein a ratio (V2/V1) of a voltage change amount V1 of the first voltage change process and a voltage change amount V2 of the second voltage change is set in a range from 0.8 to 1.2.

3. The droplet ejection head driving method of claim 1, further comprising a third voltage change process, which expands the pressure chamber, just after the second voltage change process.

4. The droplet ejection head driving method of claim 3, wherein a time interval between the second voltage change process and the third voltage change process is set to be not more than ¼ of a resonance period Tc, which is a Helmholtz resonance period, of a pressure wave which is caused by the pressure-generating means.

5. The droplet ejection head driving method of claim 4, wherein a ratio (V3/V2) of a voltage change amount V3 of the third voltage change process and a voltage change amount V2 of the second voltage change process is set in a range from 0.5 to 0.8.

6. The droplet ejection head driving method of claim 4, further comprising a fourth voltage change process, which shrinks the pressure chamber, after the third voltage change process, wherein a time interval between the third voltage change process and the fourth voltage change process is set to be not more than ⅒ of the resonance period Tm of the meniscus oscillation.

7. The droplet ejection head driving method of claim 6, wherein a ratio (V4/V3) of a voltage change amount V3 of the third voltage change process and a voltage change amount V4 of the fourth voltage change process is set in a range from 0.5 to 0.8.

8. A droplet ejection head, wherein a resonance period Tc of a pressure wave which is generated in a pressure chamber is set at not more than ¼ of a resonance period Tm of a meniscus oscillation, and the droplet ejection head is driven by a droplet ejection head driving method which applies a driving voltage waveform to pressure-generating means for pressurizing fluid in the pressure chamber and ejecting a droplet, the driving voltage waveform including a first voltage change process, which expands the pressure chamber, and a second voltage change process, which shrinks the pressure chamber, after the first voltage change process and wherein a time interval between the first voltage change process and the second voltage change process is not more than ⅛ of a resonance period Tm of the meniscus oscillation, which is a refill oscillation which is governed by surface tension of the fluid at a nozzle portion.

9. The droplet ejection head of claim 8, wherein the pressure-generating means comprises a piezoelectric element.

10. A droplet ejection head which is driven by a droplet ejection head driving method, which applies a driving voltage waveform to pressure-generating means for pressurizing fluid in a pressure chamber and ejecting a droplet, wherein the driving voltage waveform of the droplet ejection head driving method comprises: a first voltage change process, which expands the pressure chamber; and a second voltage change process, which shrinks the pressure chamber, after the first voltage change process, and wherein a time interval between the first voltage change process and the second voltage change process is not more than ⅛ of a resonance period Tm of a meniscus oscillation, which is a refill oscillation which is governed by surface tension of the fluid at a nozzle portion.

11. A droplet ejection device, wherein ejection of droplets is performed using the droplet ejection head of claim 10.

12. A droplet ejection head driving method, which applies a driving voltage waveform to pressure-generating means for pressurizing fluid in a pressure chamber and ejecting a droplet, wherein the driving voltage waveform comprises at least one of each of:

a voltage change process which expands the pressure chamber; and a voltage change process which shrinks the pressure chamber, after the voltage change process which expands the pressure chamber, and wherein a time interval between the voltage change processes is not more than a predetermined proportion relative to a resonance period Tm of a meniscus oscillation, which is a refill oscillation which is governed by surface tension of the fluid at a nozzle portion.

13. The droplet ejection head driving method of claim 12, wherein a ratio ($V_{n+1}/V_n$) of a voltage change amount $V_n$ of the voltage change process which expands the pressure chamber and a voltage change amount $V_{n+1}$ of the following voltage change process which shrinks the pressure chamber is set in a predetermined range corresponding to n, which is an integer of at least 1.

14. The droplet ejection head driving method of claim 12, wherein a resonance period Tc of a pressure wave which is generated in the pressure chamber is set at not more than ¼ of the resonance period Tm of the meniscus oscillation.

* * * * *